US011399252B2

(12) United States Patent
Maestre-Gomez et al.

(10) Patent No.: US 11,399,252 B2
(45) Date of Patent: Jul. 26, 2022

(54) METHOD AND SYSTEM FOR VIRTUAL ACOUSTIC RENDERING BY TIME-VARYING RECURSIVE FILTER STRUCTURES

(71) Applicant: OUTER ECHO INC., Montreal (CA)

(72) Inventors: Esteban Maestre-Gomez, Montreal (CA); Julius O. Smith, Palo Alto, CA (US); Gary P. Scavone, Westmount (CA)

(73) Assignee: OUTER ECHO INC., Montreal (CA)

( * ) Notice: Subject to any disclaimer, the term of this patent is extended or adjusted under 35 U.S.C. 154(b) by 0 days.

(21) Appl. No.: 17/421,535

(22) PCT Filed: Jan. 16, 2020

(86) PCT No.: PCT/IB2020/050359
§ 371 (c)(1),
(2) Date: Jul. 8, 2021

(87) PCT Pub. No.: WO2020/152550
PCT Pub. Date: Jul. 30, 2020

(65) Prior Publication Data

US 2022/0095073 A1 Mar. 24, 2022

Related U.S. Application Data

(60) Provisional application No. 62/794,770, filed on Jan. 21, 2019.

(51) Int. Cl.
*H04S 7/00* (2006.01)
*H04S 3/02* (2006.01)

(52) U.S. Cl.
CPC ..... *H04S 7/302* (2013.01); *H04S 3/02* (2013.01); *H04S 2400/01* (2013.01); *H04S 2420/01* (2013.01); *H04S 2420/03* (2013.01)

(58) Field of Classification Search
CPC .... H04S 2420/01; H04S 2400/11; H04S 7/30; H04S 7/302; H04R 5/02; H04R 3/12
(Continued)

(56) References Cited

U.S. PATENT DOCUMENTS 5,664,019 A * 9/1997 Wang ..... H04R 3/02 379/388.07
6,990,205 B1 1/2006 Chen
(Continued)

FOREIGN PATENT DOCUMENTS

CN 1879450 A 12/2006
CN 101296529 A 10/2008
(Continued)

OTHER PUBLICATIONS

International Search Report from PCT/IB2020/050359 , European Patent Office, Borowski, Michael, dated Apr. 3, 2020.
(Continued)

*Primary Examiner* — Alexander Krzystan
(74) *Attorney, Agent, or Firm* — BCF LLP

(57) ABSTRACT

Simulation of sound objects and attributes based on time-varying recursive filter structures each comprising a vector of one or more state variables and a mutable number of sound input and/or sound output signals. For simulating sound reception, the recursive update of at least one state variable involves adding an input term obtained by linearly combining input sound signals being received, wherein said combination involves time-varying coefficients adapted in response to input reception coordinates associated with said input sound signals. For simulating sound emission, state variables are linearly combined wherein said combination involves time-varying coefficients adapted in response to output emission coordinates associated with said output sound signals. Attenuation or other effects induced by sound
(Continued)

propagation and/or interaction with obstacles may be incorporated during sound emission and/or reception through scaling the time-varying coefficients involved therein. Sound propagation may be simulated by treating state variables of sound object simulations as propagating waves.

25 Claims, 27 Drawing Sheets

(58) Field of Classification Search
USPC ..... 381/310, 306, 303
See application file for complete search history.

(56) References Cited

U.S. PATENT DOCUMENTS

| | | | | |
|---|---|---|---|---|
| 2002/0055827 | A1 | 5/2002 | Kyriakakis | |
| 2008/0077476 | A1* | 3/2008 | McElhiney | G06Q 30/0202 705/7.31 |
| 2008/0077477 | A1* | 3/2008 | McElhiney | G06Q 30/0601 705/7.29 |
| 2012/0057715 | A1 | 3/2012 | Johnston et al. | |
| 2012/0243715 | A1* | 9/2012 | Pedersen | H04R 25/505 381/98 |
| 2013/0046790 | A1 | 2/2013 | Katz et al. | |
| 2014/0208300 | A1* | 7/2014 | Cheng | G06F 30/30 717/140 |
| 2014/0270189 | A1 | 9/2014 | Atkins et al. | |
| 2015/0379980 | A1 | 12/2015 | Neugebauer et al. | |
| 2017/0353811 | A1* | 12/2017 | McGibney | H04S 7/303 |
| 2017/0366913 | A1 | 12/2017 | Stein et al. | |
| 2018/0053284 | A1* | 2/2018 | Rodriguez | G06T 3/4007 |
| 2018/0226086 | A1* | 8/2018 | Huang | G10L 21/0208 |
| 2021/0092514 | A1* | 3/2021 | Agarwala | G06F 3/16 |

FOREIGN PATENT DOCUMENTS

| | | | |
|---|---|---|---|
| JP | H0651791 | A | 2/1994 |
| WO | 2017142759 | A1 | 8/2017 |

OTHER PUBLICATIONS

International Search Report from PCT/IB2020/050359 , Japanese Patent Office, Hori, Yosuke, dated Mar. 17, 2020.

International Search Report from PCT/IB2020/050359 , Korean Patent Office, Kim, Sung Hoon, dated Mar. 25, 2020.

International Search Report from PCT/IB2020/050359 , United States Patent and Trademark Office, Peek, Jane, dated Mar. 9, 2020.

International Search Report from PCT/IB2020/050359 , China National Intellectual Property Administration, Yan, Yan, dated Mar. 18, 2020.

Depalle, Philippe et al.: "State Space Sound Synthesis and a State Space Synthesiser Builder", ICMC: International Computer Music Conference, 1995, Banff, Canada, [online], [retrieved on Sep. 3, 2020], retrieved from the internet <URL: https://hal.archives-ouvertes.fr/hal-01161430/document>.

Adams, Norman H. et al., "State-Space Synthesis of Virtual Auditory Space", IEEE Transactions On Audio, Speech and Language Processing, vol. 16, No. 5, Jul. 2008, pp. 881-890.

Jyri Huopaniemi, 'Virtual Acoustics and 3-D Sound in Acoustics and 3-D Sound in Processing', Helsinki University of Technology, Espoo, Finland, 1999, [retrieved on Mar. 20, 2020]. Retrieved from: <http://research.spa.aalto.fi/publications/theses/huopaniemi_dt.pdf>.

Maestre Esteban et al., "Joint Modeling of Bridge Admittance and Body Radiativity for Efficient Synthesis of String Instrument Sound by Digital Waveguides", IEEE/ACM Transactions On Audio, Speech, and Language Processing, IEEE, USA, vol. 25, No. 5, May 1, 2017 (May 1, 2017), pp. 1128-1139, XP011647446, ISSN: 2329-9290, DOI:10.1109/TASLP.2017.2689241 [retrieved on Apr. 24, 2017].

Anonymous: "Digital filter—Wikipedia", Nov. 11, 2018 (Nov. 11, 2018), XP055670454, Retrieved from the Internet: URL:https://web.archive.org/web/20181111032842/https://en wikipedia.org/wiki/Digital filter [retrieved on Feb. 20, 2020].

Algazi et al.: "The CPIC hrtf database", IEEE Workshop on Applications of Signal Processing to Audio and Acoustics, Oct. 2001.

English abstract of CN 1879450 retreived on Espacenet on Jun. 14, 2022.

English abstract of CN 101296529 retreived on Espacenet on Jun. 14, 2022.

English abstract of JPH0651791 retreived on Espacenet on Jun. 14, 2022.

Chinese Office Action for corresponding CN application 202080010322.8 dated Jun. 6, 2022.

* cited by examiner

METHOD AND SYSTEM FOR VIRTUAL ACOUSTIC RENDERING BY TIME-VARYING RECURSIVE FILTER STRUCTURES

CROSS-REFERENCE TO RELATED APPLICATIONS

The present application is a National Stage of International Application No. PCT/IB2020/050359, filed on Jan. 16, 2020, which claims priority to U.S. Provisional Patent Application No. 62/794,770, filed on Jan. 21, 2019, each of which is incorporated herein by reference in its entirety.

TECHNICAL FIELD

The exemplary and non-limiting embodiments of the present invention generally relate to virtual acoustic rendering and spatial sound, and, more particularly, to sound objects with sound reception and/or emission capabilities, and to sound propagation phenomena.

BACKGROUND

Applications for virtual acoustic rendering and spatial audio reproduction include telepresence, augmented or virtual reality for immersion and entertainment, video-games, air traffic control, pilot warning and guidance systems, displays for the visually impaired, distance learning, rehabilitation, and professional sound and picture editing for television and film among others. The accurate and efficient simulation of objects with sound emission and/or reception capabilities remains one of the key challenges of virtual acoustic rendering and spatial audio. In general, an object with sound emission capabilities will emit sound wavefronts in all directions, propagate through air, interact with obstacles, and reach one or more sound objects with sound reception capabilities. For example, in a concert hall, an acoustic sound source such as a violin will radiate sound in all directions, and the resulting wavefronts will propagate along different paths and bounce off walls or other objects until reaching acoustic sound receivers such as human pinnae or microphones. Some techniques employ room impulse response measurements and use convolution to add reverberation to a sound signal or use modal decomposition of room impulse responses to add reverberation through parallel processing of a sound signal by upwards of one thousand recursive mode filters. These methods, though providing high fidelity, do not model the sound emission/reception properties of objects (e.g., frequency-dependent directivity) and prove inflexible for use in interactive contexts with several moving source and receivers objects. Typical rendering systems for interactive applications including several moving sources and receivers instead use superposition to separately render an early-field component and a diffuse-field component. The early-field component is generally devised to provide flexibility for simulating moving objects, and will typically include a precise representation that involves time-varying superpositions of a number of individually propagated sound wavefronts, each emitted by a sound-emitting object and experiencing a particular sequence of reflections and/or interactions with boundaries or other objects prior to reaching a sound-receiving destination object. The diffuse-field component will typically involve a less precise representation where individual paths are not treated per se.

Acoustic sound sources (e.g., the aforementioned violin), acoustic sound receivers (e.g., one member of the concert audience) and other sound objects may continuously change position and orientation with respect to one another and their environment. These continuous changes of respective position and orientation will incur in important variations in sound wavefront emission and/or reception attributes in objects, leading to modulations in various cues such as spectral content of an emitted and/or received sound. These variations arise mainly from the physical properties of simulated sound objects or the interaction between sound objects and sound wavefronts. For example, the frequency-dependent magnitude response of a sound emitted by the violin will greatly vary for different directions around the instrument. This phenomenon is typically referred to as frequency-dependent directivity, and it can be characterized by a discrete set of direction- and/or distance-dependent transfer functions. This can be equivalently characterized for sound reception: for example, the frequency-dependent directivity of a human head or human pinna is often described in terms of a discrete set of direction- and/or distance-dependent functions known as the Head-Related Transfer Functions (HRTF). In fact, among the challenges faced in virtual acoustic rendering and reproduction, modeling and simulating the directionality of sound sources and receivers is a capstone. Given the importance of HRTF for human perception of spatial sound, the quest for efficient techniques for modeling and simulating HRTF has arguably been among the most popular in the field.

In virtual environments that allow for multiple wavefronts arriving to a listener from one or several moving sources, effective interactive simulation of HRTF has been dominated by the use of FIR filters. Some typical systems for interactive HRTF simulation require a database of directional impulse or frequency responses, multiple run-time interpolations of directional responses in the form of FIR filters given the directions of incoming wavefronts, and a frequency-domain convolution engine to apply interpolated FIR filters; some of these systems require large amounts of data to store HRTF responses in the database, may incur block-based processing delay while needing a large memory bandwidth to retrieve several HRTF responses every frame, could be prone to artifacts induced by response interpolation, and may present difficulties for on-chip implementation. Other popular systems have avoided run-time retrieval and interpolation of responses by linearly decomposing an HRTF set into a fixed-size set of time-invariant FIR parallel convolution channels to achieve interactive simulation by distributing every incoming wavefront signal into all FIR channels simultaneously; these systems require all time-invariant FIR filters to be running simultaneously, thus incurring a high computational cost even for a low number of incoming sound wavefront signals.

With respect to sound source directivity, some approaches are based on frequency-domain block-based convolution, and thus may present similar drawbacks to those appearing for the case of HRTF as receivers. Other approaches for source directivity rely on accurate physical modeling of a mechanical structure through defining material and geometrical properties and then constructing an impact-driven sound radiation model for each of the vibrational modes of said structure, require run-time simulation of large quantities of said sound radiation models (each model devoted to an individual physical vibrational mode) to reproduce a wide-band sound radiation field. Other sound propagation effects, such as reflection- and/or obstacle-induced attenuation, are typically simulated either by frequency-domain block-based convolution or by means of IIR filters as separate processing components.

Accordingly, an improved approach for virtual acoustic rendering and spatial audio, and especially for modeling and numerical simulation of sound object emission and/or reception characteristics in time-varying and/or interactive contexts would be wanted. In particular, it would be desired to have a unified flexible system for simulation of sound objects and attributes which jointly treats sound emission and/or reception of objects as well as other sound attributes such as propagation-induced attenuation due to boundary reflections and/or obstacle interactions. It would be wanted that such framework allows the simultaneous simulation of multiple emission and/or reception wavefronts by moving sound objects via naturally operating on time-varying recursive filter structures exempt from FIR filter arrays or parallel convolution channels, avoiding interpolation of FIR filter coefficients or frequency-domain responses. It would be desirable that the system enables flexible trade-offs between cost and perceptual quality by enabling perceptually-motivated frequency resolutions. As well, it would be wanted that the system can be used to impose frequency-dependent sound emission or directivity characteristics on generic sound samples or non-physical signal models used as sound sources. In addition, it would be desired that the framework incurs a short processing delay, demands a low computational cost that scales well with the number of simulated wavefronts, does not need a high memory access bandwidth, requires lesser amounts of memory storage, and enables simple parallel structures that facilitate on-chip implementations.

SUMMARY

One or several aspects of the invention overcome problems and shortcomings, drawbacks, and challenges of modeling and numerical simulation of sound emitting and/or receiving objects and sound propagation phenomena in time-varying, interactive virtual acoustic rendering and spatial audio systems. While the invention will be described in connection with certain embodiments, it will be understood that the invention is not limited to these embodiments. Conversely, all alternatives, modifications, and equivalents may be included within the spirit and scope of the described invention.

In general, the present invention relates to a method and system for numerical simulation of sound objects and attributes based on a recursive filter having a time-varying structure and comprising time-varying coefficients, where the filter structure is adapted to the number of sound signals being received and/or emitted by the simulated sound object, and the time-varying coefficients are adapted in response to sound reception and/or emission attributes associated with the received and/or emitted sound signals. The inventive system provides recursive means for at least modeling sound emission and/or reception characteristics of an object or attributes of sound emitted/received by a sound object, in terms of at least one vector of state variables, wherein state variables are updated by a recursion involving: linear combinations of state variables, and time-varying linear combinations of any of the existing object inputs; and wherein the computation of the sound object outputs involves time-varying linear combinations of state variables. The inventive system enables the simulation of sound objects by means of multiple-input and/or multiple-output recursive filters of time-varying structure and time-varying coefficients, with run-time variations of said structure responding to a time-varying number of inputs and/or outputs, and with run-time variations of its coefficients responding to sound emission and/or reception attributes in the form of input and/or output coordinates associated to sound inputs and/or outputs. Those skilled in the art will generally treat multiple-input and/or multiple-output recursive filter structures as state-space filters. The present inventive system, however, allows embodiments where recursive digital filter structures have a time-varying number of inputs and/or outputs, and said structures do not strictly correspond to classic state-space filter structures where the number of inputs and/or outputs is fixed. Despite that, to facilitate the understanding and future practice of the invention we choose to nonetheless describe exemplary embodiments of the invention in state-space terms by referring to the proposed recursive filter structures as mutable state-space filters at least comprising time-varying input and/or output matrices, where the term "mutable" is used to signify that the number of inputs and/or outputs of said state-space filters can be time-varying and therefore the number of vectors comprised in said input and/or output matrices can be time-varying. As in classic state-space terms, the vectors comprised in said input matrices are referred to as input projection vectors, and the vectors comprised in said output matrices are referred to as output projection vectors.

In state-space terms, one embodiment of the inventive system will include a sound object simulation comprising: a vector of state variables, means for receiving and/or emitting a mutable number of sound input and/or output signals, means for receiving and/or emitting a mutable number of input and/or output coordinates, a mutable number of time-varying input and/or output projection vectors, and one or more input and/or output projection models describing reception and/or emission characteristics of sound objects and/or emitted/received sound attributes. As with the number of input sound signals being received by a sound object simulation, the number of input projection vectors of said sound object simulation may be time-varying, and said input projection vectors comprise time-varying coefficients that affect the recursive update of state variables through linear combinations of sound input signals. Analogously, the number of output projection vectors of a sound object simulation may be time-varying, and said output projection vectors comprise time-varying coefficients that enable the computation of sound output signals through linear combinations of state variables. In response to input and/or output coordinates indicating sound emission- and/or reception-related attributes such as direction or position with respect to involved sound objects, input and/or output projection models for a sound object are used for run-time update or computation of coefficients comprised in one or more of said time-varying input and/or output projection vectors. Input and/or output coordinates convey object-related and/or sound-related information such as direction, distance, attenuation or other attributes.

Choosing state-space terms for an exemplary embodiment and description does not represent any limitations in any other potential embodiments of the invention. To the contrary, this choice provides a most general abstraction of the filter structure such that those skilled in the art can practice the invention in diverse forms without departing from its spirit. In some cases, the state-space representation of an object simulation will present mutable inputs but non-mutable outputs (i.e., the output or outputs of said state-space filter will be fixed in number) and therefore be suited to better represent the sound reception capabilities of a given object. In some other cases, the state-space representation of an object simulation will present mutable outputs but non-mutable inputs (i.e., the input or inputs of said state-space filter will be fixed in number) and therefore be suited to better represent the sound emission capabilities of a given object. This shouldn't impede designs where the state-space representation of an object simulation presents both mutable inputs and mutable outputs. In general, for an improved performance, said state-space filters might preferably be expressed in modal form through a parallel combination of first- and/or second-order recursive filters whereby obtaining the respective inputs of said first-order and/or second-order recursive filters involves time-varying linear combinations of any number of input sound signals being received by the sound object simulation at a given time, and whereby obtaining any number of output sound signals being emitted by said sound object simulation at a given time involves time-varying linear combinations of the outputs of said first- and/or second-order filters. In all of these cases, the spirit ofthe invention is maintained in that state variables are updated by a recursion involving linear combinations of state variables and linear combinations of any of the existing object sound input signals, and in that the computation of the object sound output signals involves linear combinations of state variables. In state-space terms, the inventive filter structure could be described as time-varying state-space filter comprising one of a time-varying input matrix and/or time-varying output matrix, wherein said input matrix presents a fixed or mutable size depending on the number of input sound signals being received by the sound object simulation at a given time, and said input matrix comprises time-varying coefficients; and wherein said output matrix presents a fixed or mutable size depending on the number of output sound signals being emitted by the sound object simulation at a given time, and said output matrix comprises time-varying coefficients.

In one embodiment of the inventive system, a sound object simulation model is built by defining the state transition matrix of a state-space recursive filter structure and designing input and/or output projection models for size-varying and/or time-varying operation of said filter. Said state transition matrix constitutes a general representation of the linear combinations of state variables involved in the recursion employed to update state variables, but for efficiency in the recursive update of said state variables, for modeling accuracy, and for effectiveness in the time-varying computation of input and/or output projection coefficient vectors, a preferred embodiment of the invention will comprise a state transition matrix expressed in modal form in terms of a vector of eigenvalues. In some embodiments of the system, a sound object simulation model is built by direct design of a state-space recursive filter in modal form by arbitrary placing a set of eigenvalues on a complex plane and designing input and/or output projection models for time-varying operation of the filter, while in other embodiment of the system the method of placing eigenvalues and construction of input and/or output projection models is performed by attending to sound object reception and/or emission characteristics as observed from empirical or synthetic data. In several preferred embodiments of the invention, perceptually-motivated frequency resolutions are used for placing of eigenvalues and/or constructing input and/or output projection models. In diverse embodiments of the invention, modal forms of a state transition matrix lead to realizations in terms of parallel combinations of first- and/or second-order recursive filters; accordingly, some embodiments of the invention will be based on direct design of said parallel first- and/or second-order recursive filters. In various embodiments of the inventive system, input and/or output projection models comprising parametric schemes and/or lookup tables and/or interpolated lookup tables are used in conjunction with input and/or output coordinates for run-time updating or computing coefficients of one or several input-to-state and/or state-to-output projection vectors. In some further embodiments of the system, sound object simulation models may represent sound-receiving capabilities only, sound-emitting capabilities only, or both sound-emitting and sound-receiving capabilities. In some embodiments of the invention, the propagation of sound from a sound-emitting object to a sound-receiving object is performed using delay lines to propagate signals from the outputs of sound-emitting objects to the inputs of sound-receiving objects. In some further embodiments, frequency-dependent attenuation or other effects derived from sound propagation and/or interaction with obstacles is simulated by attenuation of state variables or by manipulation of input and/or output projection vector coefficients involved in sound reception and/or emission by a sound object. In a different embodiment of the system, sound propagation is simulated by treating state variables of state-space filters as waves propagating along delay lines to facilitate implementations wherein, while allowing the simulation of directivity in both sound source objects and sound receiver objects, the number of delay lines used is independent of the number of sound wavefront paths being simulated.

One or more aspects of the invention have the aim of providing desired qualities for modeling and numerical simulation of sound emitting and/or receiving objects and sound propagation phenomena in time-varying, interactive virtual acoustic rendering and spatial audio systems. These qualities include: naturally operating on size-varying and time-varying recursive filter structures exempt FIR filter arrays or FIR coefficient interpolations, avoiding explicit physical modeling of sound objects and/or block-based convolution processing and response interpolation artifacts, allowing flexible trade-offs between cost and perceptual quality by facilitating the use of perceptually-motivated frequency resolutions, enabling the imposition of frequency-dependent sound emission characteristics on either sound signal models or sound sample recordings used in sound source objects; incurring a short processing delay; demanding a low computational cost and low memory access bandwidth; requiring lesser amounts of memory storage; aiding in decoupling computational cost from spatial resolution; and leading to simple parallel structures that facilitate on-chip implementations.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out or suggested by the detailed description below, and supported by the appended claims.

DESCRIPTION OF DRAWINGS

These and other aspects of the present invention will become apparent to those ordinarily skilled in the art upon review of the following specification describing non-limiting embodiments of the invention, in conjunction with the accompanying figures wherein.

DETAILED DESCRIPTION

In this invention, the numerical simulation of sound objects and attributes is based on recursive digital filters of time-varying structure and time-varying coefficients. In one exemplary embodiment of the invention, the inputs of said recursive filters represent sound signals being received by sound objects, while the output of said recursive filters represent sound signals being emitted by said sound objects. In simulation contexts where a number of sound objects interactively appear, disappear, or move through a virtual space, tracking and rendering of time-varying sound reflection and/or propagation paths for sound wavefronts will require that sound source objects emit a time-varying number of sound signals, and sound receiver objects receive a time-varying number of sound signals. The time-varying structure of the proposed recursive filters facilitates the simulation of a time-varying number of inputs and/or outputs for sound object simulations: one of said recursive filters may be used to simulate a sound object capable of emitting a time-varying number of sound signals, or alternatively a sound object capable of receiving a time-varying number of sound signals; note that this does not impede simulating a sound object capable of emitting and receiving a time-varying number of sound signals. In several embodiments of the invention, delay lines will be used to propagate sound signals from the output of a sound-emitting object simulation to the input of a sound-receiving object simulation. The sound emission and/or reception characteristics of objects will often depend on contextual features such as relative orientation or position of objects (for instance, to simulate frequency-dependent directivity in sources and/or receivers) while the paths associated with emitted and/or received sound wavefronts are being tracked. The time-varying nature of the coefficients of said recursive filter structures enables the simulation of those context-dependent sound emission and/or reception attributes, independently for each of the emitted and/or received sound wavefront: a vector of one or more time-varying coefficients is associated with one of the filter's inputs and/or outputs being emitted and/or received, and said vector of time-varying coefficients are provided to the recursive filter structure by purposely devised models in response to one or more time-varying coordinates indicating context-dependent sound emission and/or reception attributes (for instance, orientation, distance, etc.).

Figure 1:
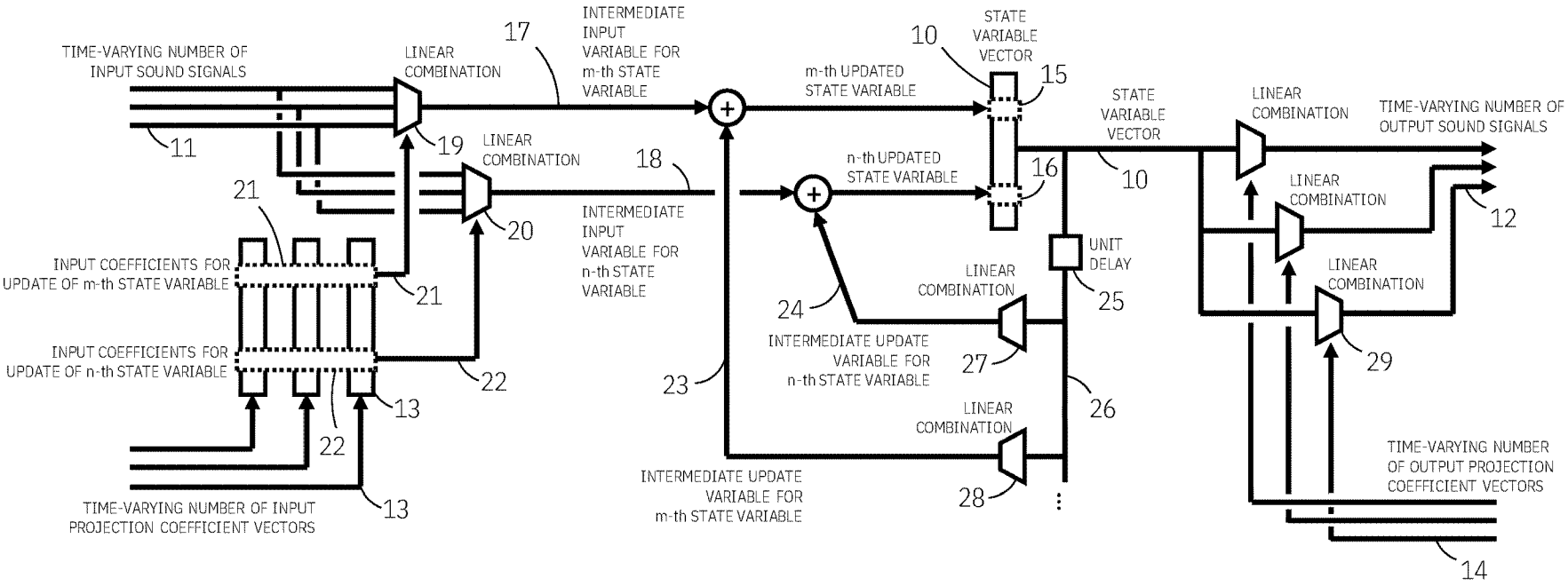
FIG. 1 is a block-diagram of an example general structure of a time-varying recursive filter employed for simulation of sound objects and attributes according to embodiments of the invention. State variables of the recursive filter structure are recursively updated by linear combinations of said state variables and time-varying linear combinations of a time-varying number of input sound signals where said time-varying linear combinations are determined by input projection coefficient vectors associated to said input sound signals. A time-varying number of output sound signals is obtained by time-varying linear combinations of state variables wherein said time-varying linear combinations are determined by output projection vectors associated to said output sound signals.
Figure 2:
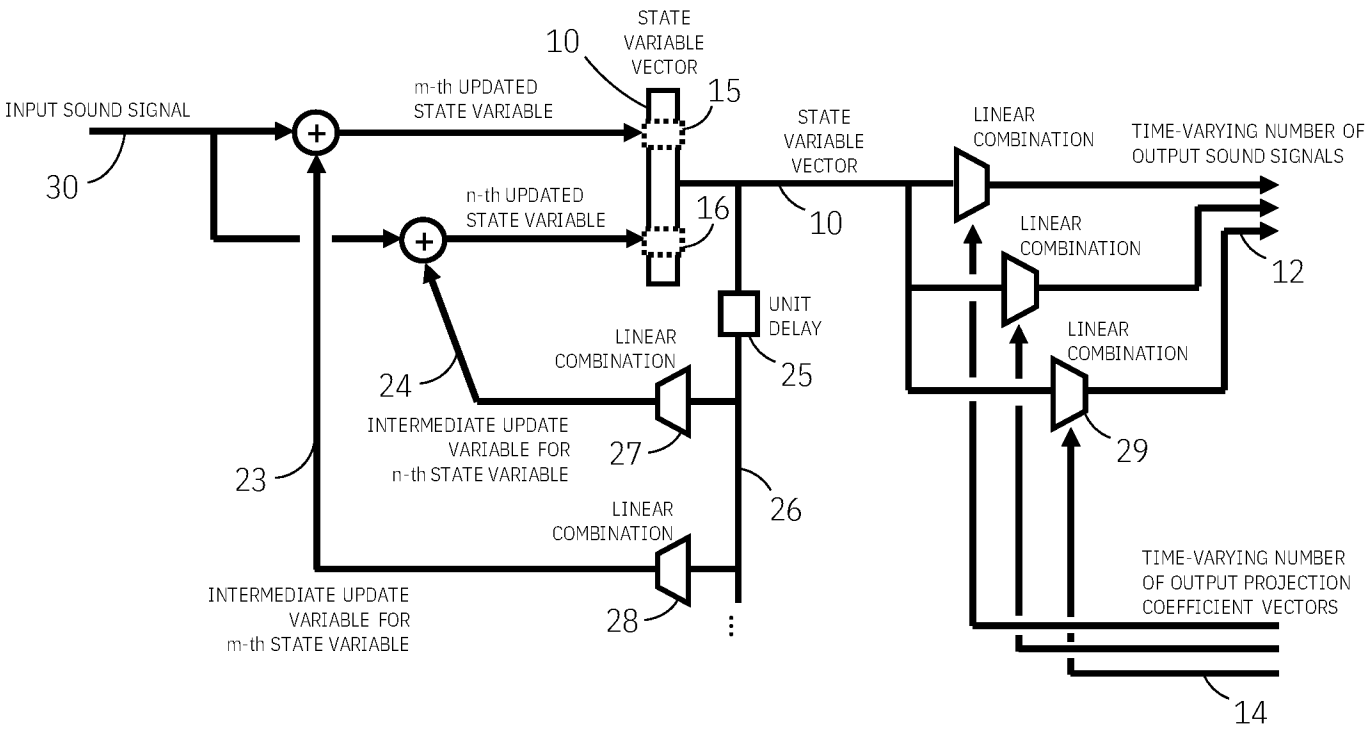
FIG. 2 is a block diagram of an example general structure of a time-varying recursive filter similar to that of FIG. 1, but focused on exemplifying the simulation of sound emission by sound objects.
Figure 3:
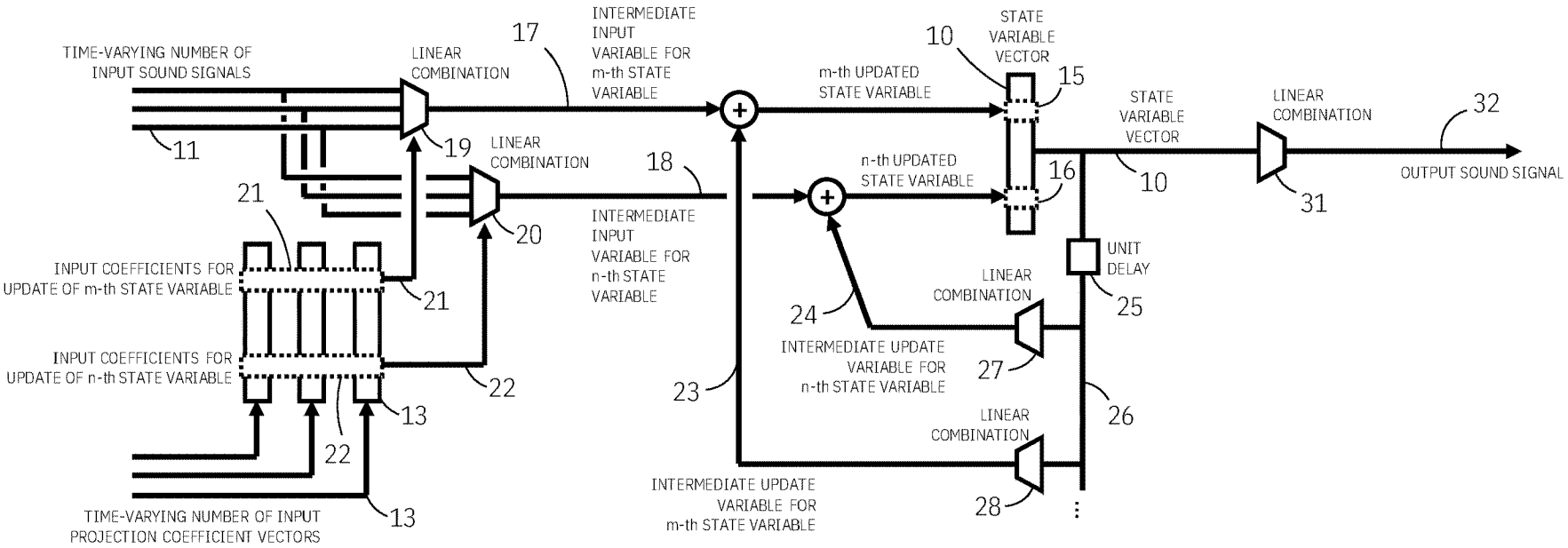
FIG. 3 is a block diagram of an example general structure of a time-varying recursive filter, similar to that of FIG. 1, but focused on exemplifying the simulation of sound reception by sound objects.

Each of the time-varying recursive filter structures employed to embody the inventive system comprise at least a vector of state variables, a variable number of input and/or output sound signals, and a variable number of input and/or output projection coefficient vectors associated with said input and/or output sound signals, wherein the coefficients of said projection vectors are adapted in response to sound reception and/or emission coordinates of said input and/or output sound signals. Each time step, at least one of said state variables is updated by means of a recursion which involves summing two intermediate variables: an intermediate update variable obtained by linearly combining one or more of the state variable values of the previous time step, and an intermediate input variable obtained by linearly combining one or more of the input sound signals being received. Obtaining one or more of the output sound signals being emitted comprises linearly combining one or more of the state variables. The weights involved in the state variable linear combinations used to compute said intermediate update variables are time-invariant and independent on context-related emission or reception attributes. The weights involved in linearly combining input sound signals to obtain said intermediate input variables are time-varying and dependent on context-related reception attributes: said weights are comprised in a time-varying number of time-varying input projection coefficient vectors respectively associated with input sound signals, wherein said input projection vectors are provided by purposely devised models in response to one or more coordinates indicating context-dependent sound reception attributes associated with said input sound signals. Analogously, the weights involved in linearly combining state variables to obtain a time-varying number of output sound signals are time-varying and dependent on context-related emission attributes: said weights are comprised in a time-varying number of time-varying output projection coefficient vectors respectively associated with output sound signals, wherein said output projection vectors are provided by purposely devised models in response to one or more coordinates indicating context-related sound emission attributes associated with said output sound signals. A first general embodiment of the recursive filter structure is depicted in FIG. 1 for the case of three input 11 and output 12 sound signals and three input 13 and output 14 projection coefficient vectors, although an equivalent depiction could describe any analogous filter structure with any time-varying number of inputs and/or outputs and, accordingly, any time-varying number of input and/or output projection coefficients. For clarity, the depiction of FIG. 1 only illustrates the update process corresponding to the m-th state variable 15 and the n-th state variable 16 of the state variable vector 10. To update the m-th state variable, two intermediate variables are computed: an m-th intermediate input variable 17 obtained by linearly combining 19 said input sound signals, and an m-th intermediate update variable 23 obtained by linearly combining 27 the state variables of the preceding step 25,26; the weights 21 involved in linearly combining input sound signals to obtain said m-th intermediate input variable are collected from the m-th positions 21 in the respective input projection coefficient vectors. Accordingly, to update the n-th state variable, two intermediate variables are computed: an n-th intermediate input variable 18 obtained by linearly combining 20 said input sound signals, and an m-th intermediate update variable 24 obtained by linearly combining 28 the state variables of the preceding step 25,26; the weights 22 involved in linearly combining input sound signals to obtain said n-th intermediate input variable are collected from the n-th positions 22 in the respective input projection coefficient vectors. To obtain one of the output sound signals 12, the state variables 10 are linearly combined 29 wherein the coefficients employed in said linear combination are collected from the corresponding output projection coefficient vector 14. When only simulating sound emission characteristics of a sound object, an embodiment of said recursive filter structure could be simplified as depicted in FIG. 2 and would require a vector of state variables, a variable number of output sound signals, and a variable number of output projection coefficients; note that a single input sound signal 30 with equal distribution among state variables could be used in this case. Conversely, when only simulating sound reception characteristics of a sound object, an embodiment of said recursive filter structure could be simplified as depicted in FIG. 3 and would require a vector of state variables, a variable number of input sound signals, and a variable number of input projection coefficients; note that a single output sound signal 32 could be obtained by linearly combining 31 state variables.

Mutable State-Space Filter Representation

To more generally describe and practice diverse embodiments of the proposed recursive filter structure, we find convenient to accommodate the time-varying number of inputs and/or outputs and the associated time-varying projection coefficient vectors by employing state-space terms to express a minimal realization of the filter structure as a mutable state-space filter of the form $$\underline{s}[n+1] = A\ \underline{s}[n] + \text{sum_p}(\underline{b}^p[n]x^p[n]) \tag{1}$$
$$y^q[n] = \underline{c}^q[n]^T\underline{s}[n]$$

where the term mutable is used to emphasize that the number of inputs and/or outputs of said state-space filter can mutate dynamically, n is the time index, $\underline{s}[n]$ is a vector of M state variables, A is a state transition matrix, $x^p[n]$ is the p-th component of the input vector and corresponds to the p-th input (a scalar) of the P inputs existing at time n, $\underline{b}^p[n]$ is its corresponding length-M vector of input projection coefficients, $y^q[n]$ is the q-th component of the output vector and corresponds to the q-th output (a scalar) of the Q outputs existing at time n, and $\underline{c}^q[n]$ is its corresponding length-M vector of output projection coefficients. Without loss of generality and to facilitate the understanding and practice of the invention to those skilled in the art, we will employ this representation in some reference exemplary embodiments to provide a most general abstraction and concise representation of key components of the inventive system. However, it should be noted that the mutable state-space representation is not a limiting representation: it equivalently embodies receiver object simulations with mutable inputs but non-mutable single or multiple outputs, source object simulations with mutable outputs but non-mutable single or multiple inputs, or any variation of the filter structures previously described and exemplified in FIG. 1, FIG. 2, and FIG. 3. We will also see later that, without departing from the spirit of the invention, modal-form mutable state-space filters with diagonal or block-diagonal transition matrices can be equivalently exercised by those skilled in the art to simulate sound source and/or receiver objects in terms of parallel combinations of first- and/or second-order recursive filters. But for now, however, we will restrict to describe embodiments as facilitated by the mutable state-space representation given its convenience.

The time-varying vector $\underline{b}^p[n]$ of input projection coefficients enables the simulation of time-varying reception attributes corresponding to the p-th input sound signal or input sound wavefront signal, while the time-varying vector $\underline{c}^q[n]$ of output projection coefficients enables the simulation of time-varying emission attributes corresponding to the q-th output sound signal or output sound wavefront signal. Note that, as opposed to the classic, fixed-size matrix-based state-space model notation, here we resort to a more convenient vector notation because both the number of inputs and/or outputs and the coefficients in their corresponding projection vectors are allowed to change dynamically. The state update equation (top) comprises the state variable linear recursion term $\underline{s}[n+1]=A\ \underline{s}[n]$ through which state variables are linearly combined, and P input projection terms $\underline{b}^p[n]x^p[n]$ through which each p-th input signal is projected onto the space of state variables. Thus, in its most general basic form, the update of the m-th state variable involves a linear combination of state variables (determined by matrix A) and a linear combination of P input variables (determined by the coefficients at the m-th position of all P input projection vectors $\underline{b}^p[n]$). The output equation (bottom) comprises Q output projection terms $\underline{c}^q[n]^T\underline{s}[n]$ through which states are projected onto Q output signals. Accordingly, in its most general basic form, the computation of the q-th output signal involves a linear combination of state variables. Since the number P of inputs and the coefficients of their associated input projection vectors $\underline{b}^p[n]$ may in general be time-varying, a matrix-form expression for the right side of the summation in the state-update equation (top) would require a matrix B[n] of time-varying size and time-varying coefficients. Analogously, a matrix-form expression for the output equation (bottom) would require a matrix C[n] of time-varying size and time-varying coefficients. Note that, to keep the description simple, in this exemplary state-space formulation of the recursive filter structure we have not included a feedforward term as commonly found in some classic state-space formulations of recursive filters. It should be made clear that, although the embodiments explicitly described here will not present a direct input-output relationship by including a feedforward term, incorporating the term would not depart from the spirit of the invention.

As with classic state-space recursive filters, a preferred form for Equation (1) involves a matrix A that is diagonal.

In such form, which results in efficient realizations, the diagonal elements of matrix A hold the recursive filter eigenvalues. Such diagonal form of matrix A implies that, for each m-th intermediate update variable 23 used in the recursive update of each m-th state variable 15, the weight vector employed for linearly combining 24 state variables reduces to a vector wherein all coefficients are zero except for the m-th coefficient being the m-th eigenvalue of the filter. Without loss of generality, below we assume a diagonal form for matrix A to describe a number of preferred state-space embodiments for the invention to provide state means for simulating sound-emitting and/or sound-receiving objects.

Figure 4:
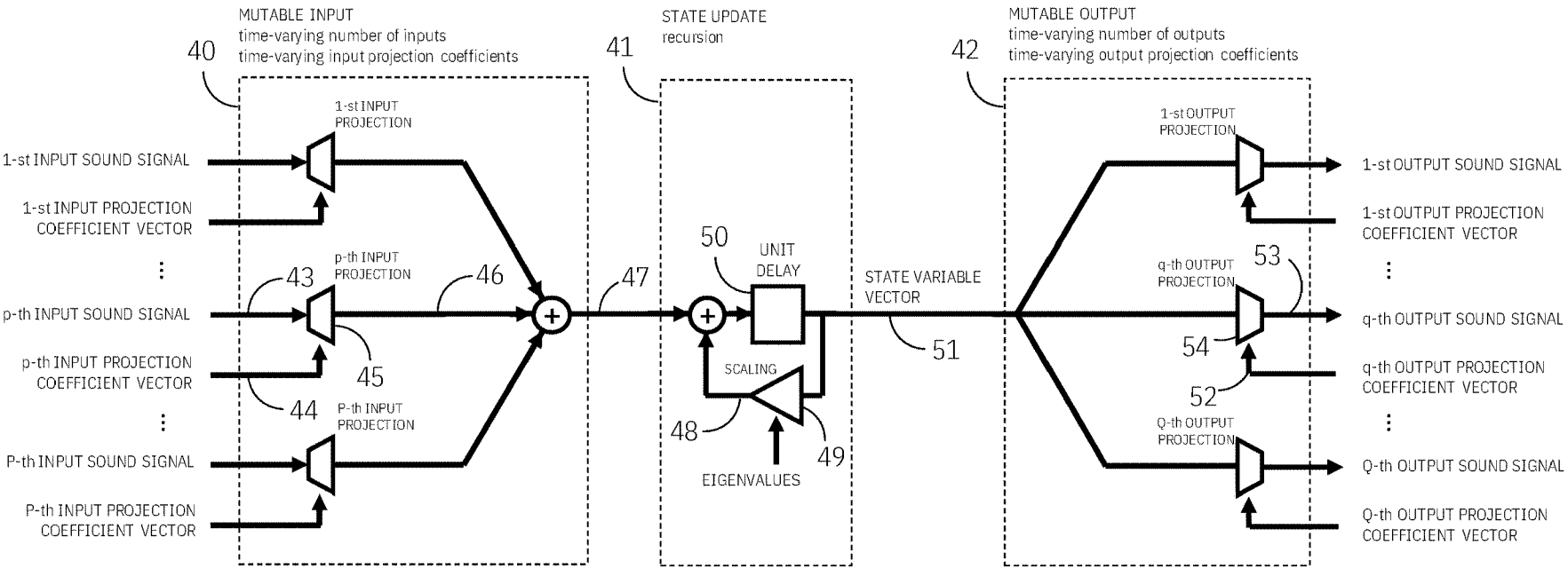
FIG. 4 is a block diagram of an embodiment consisting of a time-varying recursive filter employed for simulation of sound objects and attributes according to embodiments of the invention, similar to that of FIG. 1, but expressed in time-varying 'mutable' state-space form with time-varying number of input and/or output sound signals.

In forms of the invention embodied by mutable state-space structures, source objects may be represented as mutable state-space filters for which their outputs are mutable but their inputs are non-mutable (i.e., a fixed number of inputs and input projection coefficients); conversely, receiver objects may be represented as mutable state-space filters for which their inputs are mutable but their outputs are non-mutable (i.e., a fixed number of outputs and output projection coefficients). The general filter structure described by Equation (1) constitutes a convenient general embodiment of the simulation of a sound object which models both sound-emitting and sound-receiving behaviors, with a mutable number of input and output signals. This is depicted in FIG. 4, where three main parts are represented: a mutable input part 40, a state recursion part 41, and a mutable output part 42. In state-space terms, the state update relation (top) of Equation (1) is embodied by the mutable input part 40 and the state recursion part 41, while the output relation (bottom) of Equation (1) is embodied by the mutable output part 42. The mutable input part 41 comprises a time-varying number of input sound signals and a time-varying number of input projection coefficient vectors associated with said input sound signals, wherein said input projection vectors comprise time-varying coefficients. This is illustrated for three input sound signals and corresponding input projection vectors, but an equivalent structure would apply for any time-varying number of input sound signals: assuming that at a given time the object simulation is receiving P input sound wavefront signals, each p-th input sound signal 43 will be projected 45 onto the space of states of the filter through multiplication by a corresponding p-th vector 44 of time-varying input projection coefficients. This multiplication leads to a p-th intermediate input vector 46. In the recursion part 41, the vector of state variables 51 is updated by summing two vectors: a vector 48 comprising scaled versions 49 of unit-delayed 50 state variables wherein the scaling factors correspond to the filter eigenvalues 49, and a vector 47 obtained from summing all P intermediate input vectors 46. The mutable output part 42 comprises a time-varying number of output sound signals and a time-varying number of output projection coefficient vectors associated with said output sound signals, wherein said output projection vectors comprise time-varying coefficients. This is illustrated for three output sound signals and corresponding output projection vectors, but an equivalent structure would apply for any time-varying number of output sound signals: assuming that at a given time the object simulation is emitting Q output sound wavefront signals, each q-th output sound signal 53 will be obtained by linearly combining 54 state variables 51 wherein the weights 52 used in said linear combination are provided by the q-th vector 52 of time-varying output projection coefficients.

Figure 5:
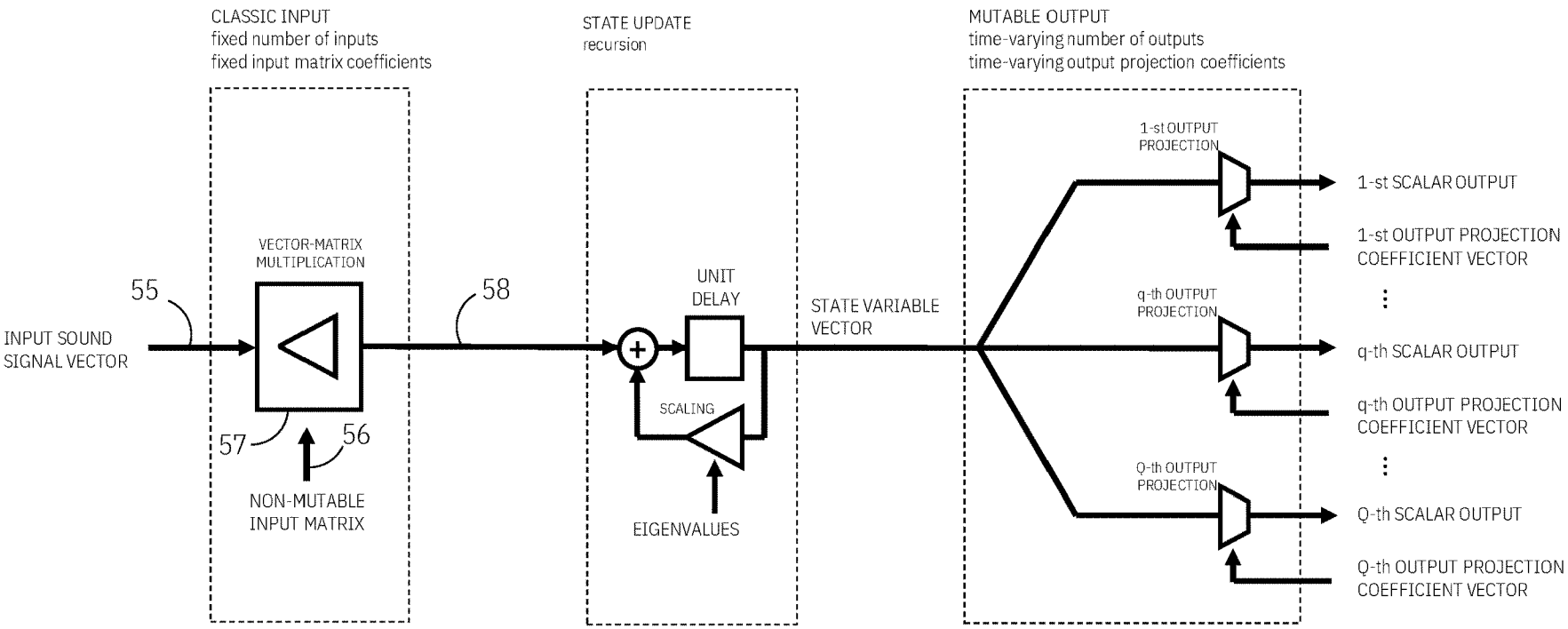
FIG. 5 is a block diagram of an embodiment consisting of a time-varying recursive filter similar to that of FIG. 4, but focused on exemplifying the simulation of sound emission by sound objects, with a fixed number of input sound signals and a time-varying number of output sound signals with time-varying emission attributes.
Figure 6:
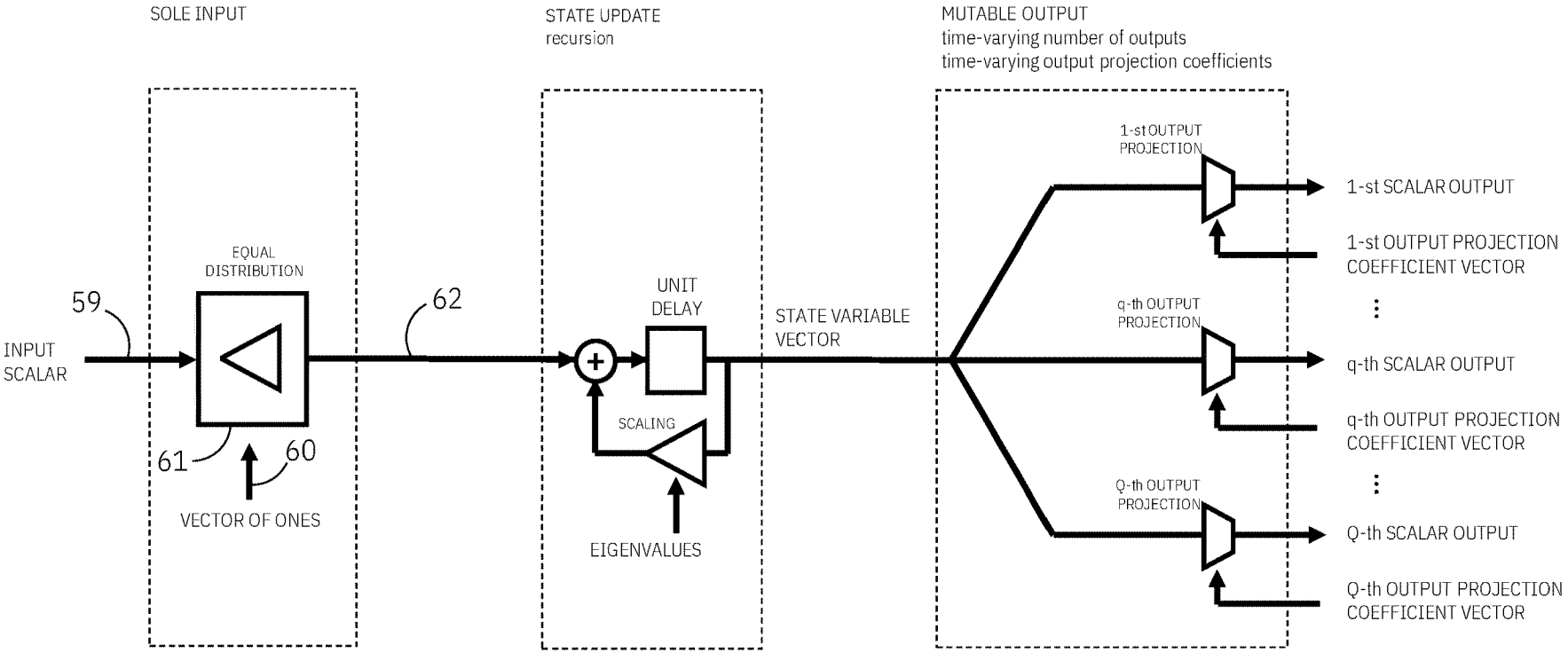
FIG. 6 is a block diagram of an embodiment consisting of a time-varying recursive filter similar to that of FIG. 5, but with a sole input sound signal.
Figure 7:
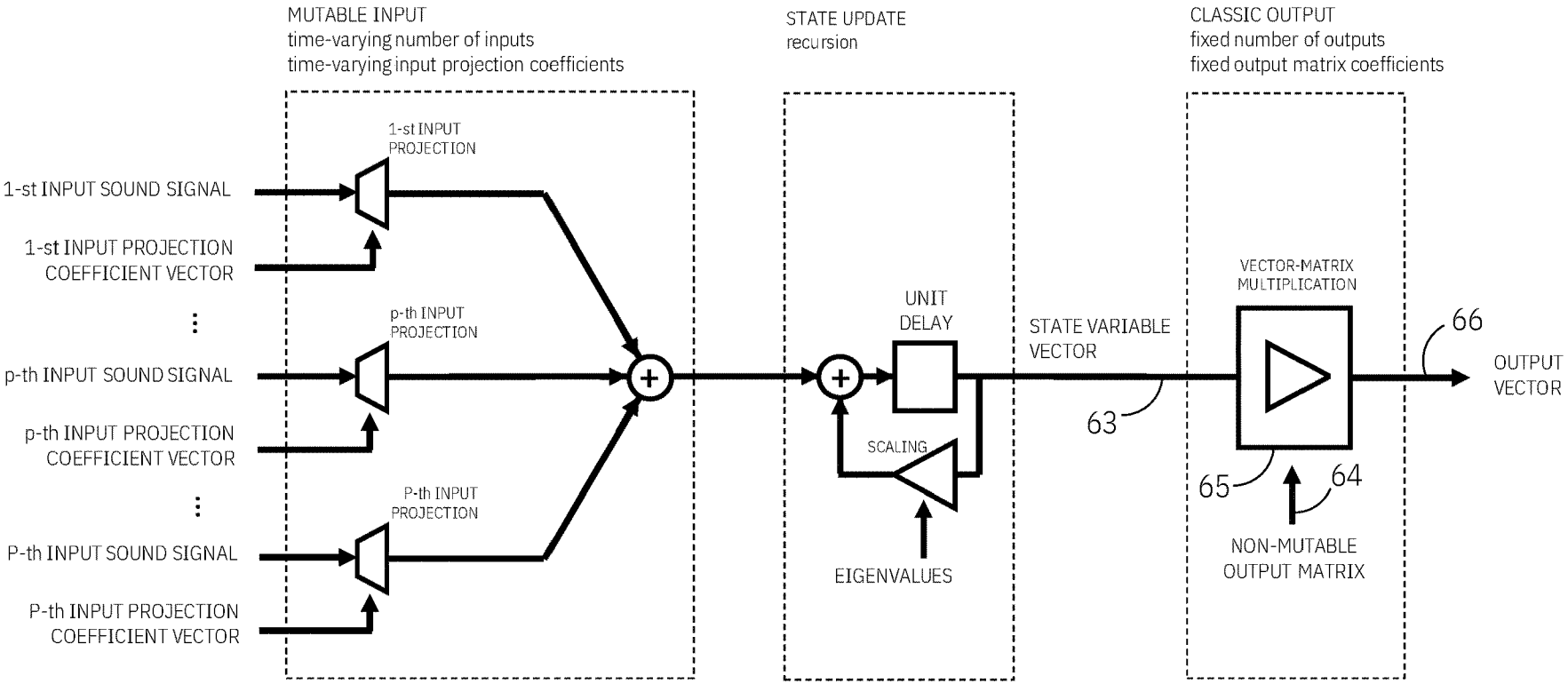
FIG. 7 is a block diagram of an embodiment consisting of a time-varying recursive filter similar to that of FIG. 4, but focused for simulation of sound reception by sound objects, with a fixed number of output sound signals and a time-varying number of input sound signals with time-varying reception attributes.
Figure 8:
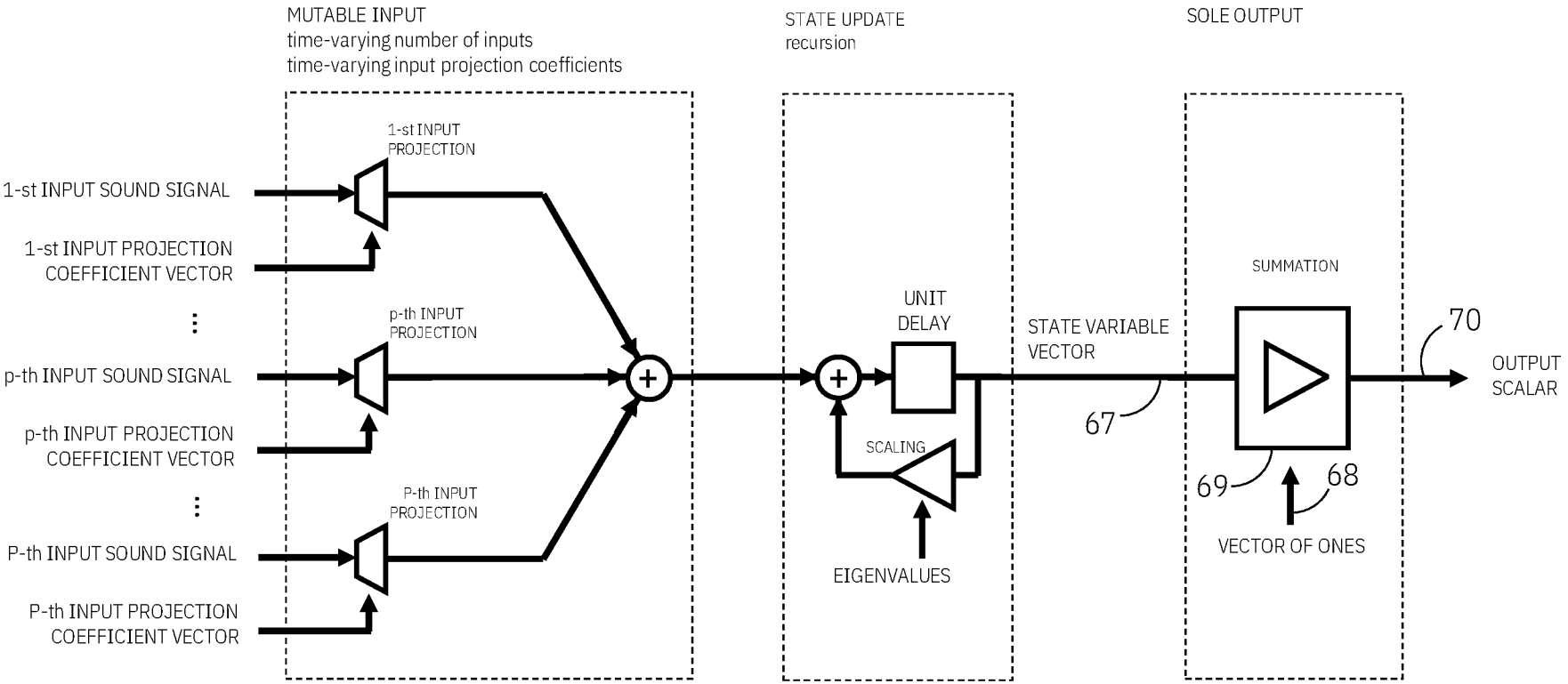
FIG. 8 is a block diagram of an embodiment consisting of a time-varying recursive filter similar to that of FIG. 7, but with a sole output sound signal.

As mentioned earlier, sound source object simulations can be embodied by mutable state-space filters for which their outputs are mutable but their inputs are non-mutable. To exemplify this, two non-limiting embodiments for sound source object simulations are depicted in FIG. 5 and FIG. 6. In FIG. 5 we illustrate the case of a sound source object simulation being embodied by a mutable state-space filter where its output part is mutable and its input part is classic (i.e., non-mutable); in this case, the input part of the sound object simulation filter behaves similarly to that of a classic state-space filter where its input matrix 56 has a fixed size and, accordingly, a fixed-size vector of input sound signals 55 is multiplied 57 by said input matrix 56 to obtain the vector 58 of joint contributions leading to the update of state variables. A further simplification is illustrated in FIG. 6, where a sole input sound signal 59 is equally distributed 60,61 into the elements of a vector 62 employed for updating the state variables; note that this simplification is equivalent to having a vector of ones 60 as input matrix. Analogously to the sound source object simulations, sound receiver object simulations can be embodied by mutable state-space filters for which their inputs are mutable but their outputs are non-mutable. Accordingly, two non-limiting embodiments for sound receiver object simulations are depicted in FIG. 7 and FIG. 8. In FIG. 7 we illustrate the case of a sound receiver object simulation being embodied by a mutable state-space filter where its input part is mutable and its output part is classic (i.e., non-mutable); in this case, the output part of the sound object simulation filter behaves similarly to that of a classic state-space filter where its output matrix 64 has a fixed size and, accordingly, a fixed-size vector of output sound signals 66 is obtained by multiplying 65 the vector 63 of state variables and said output matrix 64. A further simplification is illustrated in FIG. 8, where a sole output sound signal 70 is obtained by summing 68,69 the state variables 67; note that this simplification is equivalent to having a vector of ones 69 as output matrix.

Input and Output Projection Models

Given time-varying input and/or output contextual coordinates associated with the input and/or output signals of sound object simulations, input and/or output projection models provide the time-varying coefficient vectors that enable the simulation of time-varying sound reception and/or emission by sound objects. In state-space terms, input and output projection models accordingly facilitate the coefficients comprised in time-varying input and/or output matrices required to project the received input sound wavefront signals onto the space of state variables of a recursive filter, and/or to project the state variables of a recursive filter onto the emitted output sound wavefront signals. For example, the reception coordinates (i.e. the input coordinates) associated with one input signal of a sound receiver object may refer to the position or orientation from which the receiver object is excited by a sound wavefront. In accordance with embodiments of the inventive recursive filter where only the outputs of sound source object simulations are mutable and only the inputs of sound receiver object simulations are mutable, without loss of generality we hereby associate input projection models with receiver object simulations and output projection models to source object simulations.

Figure 9A:
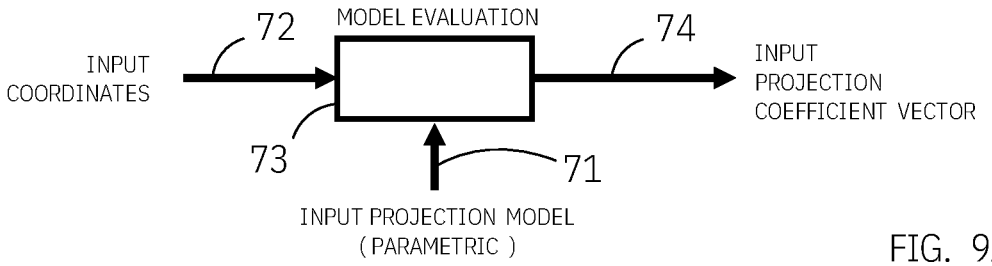
FIG. 9A is a block diagram illustrating the use of a parametric input projection model for obtaining a vector of input projection coefficients given the parameters of said projection model and a vector of input coordinates associated with an input sound signal received by a sound object simulation.
Figure 9B:
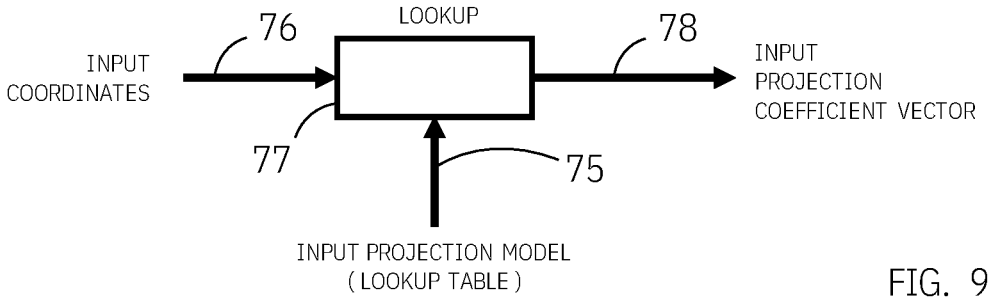
FIG. 9B is a block diagram representing the use of a lookup table for obtaining a vector of input projection coefficients given a table of input projection coefficients and a vector of input coordinates associated with an input sound signal received by a sound object simulation.
Figure 9C:
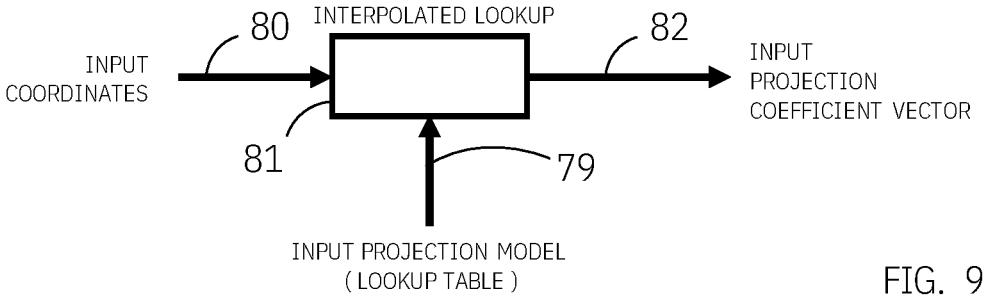
FIG. 9C is a block diagram representing the use of an interpolated lookup table for obtaining a vector of input projection coefficients given a table of input projection coefficients and a vector of input coordinates associated with an input sound signal received by a sound object simulation.

Given an input projection model V and a vector $\underline{\beta}^p[n]$ of time-varying input (reception) coordinates associated with to the p-th input sound signal being emitted by the sound object simulation at time n, the input projection function $S^+$ of a receiver object simulation provides the vector $\underline{b}^p[n]$ of input projection coefficients corresponding to said p-th input sound signal. This can be expressed as $$\underline{b}^p[n] = S^+(V, \underline{\beta}^p[n]), \quad (2)$$

and three different case uses are illustrated in FIG. 9A, FIG. 9B, and FIG. 9C. In FIG. 9A the projection model 71 is parametric and, given a vector 72 of input coordinates, a vector 74 of input projection coefficients is provided by evaluating 73 said projection model. In FIG. 9B the projection model 75 is based on tables of known input coefficient vectors and, given a vector 76 of input coordinates, a vector 78 of input projection coefficients is provided by looking up 77 one or more tables 75. Similarly, in FIG. 9C the projection model 79 is based on tables of known input coefficient vectors and, given a vector 80 of input coordinates, a vector 82 of input projection coefficients is provided by performing one or more interpolated lookup 81 operations on one or more tables 79.

Figure 10A:
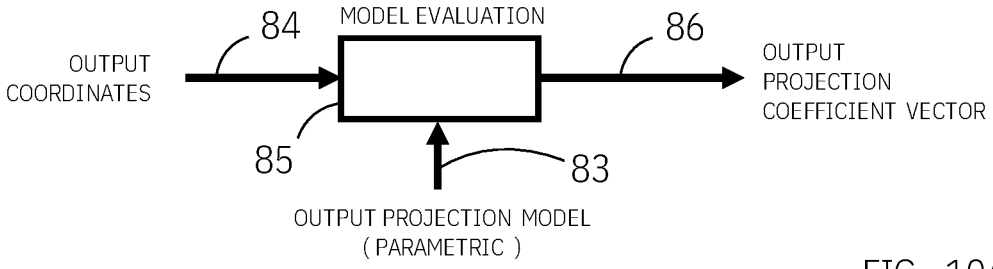
FIG. 10A is a block diagram representing the use of a parametric output projection model for obtaining a vector of output projection coefficients given the parameters of said projection model and a vector of output coordinates associated with an output sound signal emitted by a sound object simulation.
Figure 10B:
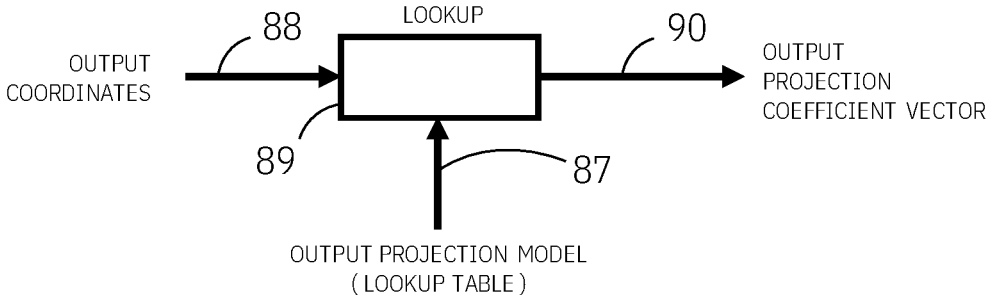
FIG. 10B is a block diagram representing the use of a lookup table for obtaining a vector of output projection coefficients given a table of output projection coefficients and a vector of output coordinates associated with an output sound signal emitted by a sound object simulation.
Figure 10C:
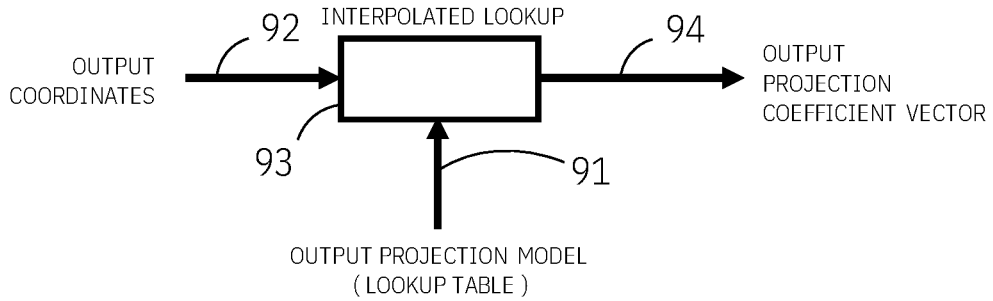
FIG. 10C is a block diagram representing the use of an interpolated lookup table for obtaining a vector of output projection coefficients given a table of output projection coefficients and a vector of output coordinates associated with one or more output sound signals emitted by a sound object simulation.

Accordingly, given an output projection model K and a vector $\underline{\gamma}^q[n]$ of time-varying output (emission) coordinates associated to the q-th output sound signal being emitted by the source object simulation at time n, the output projection function $S^-$ of a source object simulation provides the vector $\underline{c}^q[n]$ of output projection coefficients corresponding to said q-th output sound signal. This can be expressed as $$\underline{c}^q[n] = S^-(K, \underline{\gamma}^q[n]), \quad (3)$$

and three different cases are illustrated in FIG. 10A, FIG. 10B, and FIG. 10C. In FIG. 10A the projection model 83 is parametric and, given a vector 84 of output coordinates, a vector 86 of output projection coefficients is provided by evaluating 85 said projection model. In FIG. 10*b* the projection model 87 is based on tables of known output coefficient vectors and, given a vector 88 of output coordinates, a vector 90 of output projection coefficients is provided by looking up 89 one or more tables 87. Similarly, in FIG. 10C the projection model 91 is based on tables of known output coefficient vectors and, given a vector 92 of output coordinates, a vector 94 of output projection coefficients is provided by performing one or more interpolated lookup 91 operations on one or more tables 91.

Note that, for efficiency purposes, to practice the invention it is not required to employ input and/or output projection models at every discrete time step of the simulation. Instead projection models can be employed periodically to obtain projection vectors every few discrete time steps (for instance, every few dozens or hundreds of discrete time steps), and employ any required means for interpolating along the missing discrete time steps.

Design of Sound Object Simulations

In preferred embodiments of the inventive system, a recursive filter structure for a sound object simulation is constructed to at least simulate a desired sound reception and/or emission behavior of the object. Said behavior will be often prescribed by synthetic or observed data. In some of the preferred embodiments, the desired reception or emission behaviour of a sound object can be first defined by synthesizing or measuring a set of discrete minimum-phase impulse or frequency responses each corresponding to a discrete point or region in the space of input sound reception coordinates or output sound emission coordinates for a sound object. For example, the output coordinate space for sound emission in a violin simulation can be defined as a two-dimensional space where the dimensions are two orientation angles defining the outgoing direction for an emitted sound wavefront as departing from a sphere around the violin. A similar coordinate space can be imposed for sound wavefronts received by one ear of a human head, for instance. Note that further coordinates, as for instance related to distance or attenuation, occlusion, or other effects may be incorporated.

Again for reasons of convenience in facilitating the understanding and future practice of the invention in all of its variants, we employ a mutable state-space representation for the recursive filter structure to describe here a familiar three-stage design procedure. The procedure assumes a diagonal state transition matrix. In a first step, the eigenvalues of a classic, fixed-size multiple-input and/or multiple output state-space filter are identified from data or arbitrarily defined; in a second step, the fixed-size, time-invariant input and/or output matrices of said classic state-space filter are obtained from prescribed data in the form of discrete impulse or frequency responses; in a third step, input and/or output projection models are constructed to work either through parametric schemes or by interpolation. Note that, instead of limiting the practice of the inventive system, the preferred design procedure outlined here should be understood as exemplary. Future practitioners may be inspired by this procedure and choose to alter it in any desired way as long as the resulting recursive filter structure serves their needs for sound object simulation as taught by the invention.

Though not essential, imposing minimum-phase is generally preferred. In particular for HRTF, Nam et al. suggest in "On the Minimum-Phase Nature of Head-Related Transfer Functions", *Audio Engineering Society 25th Convention*, October 2008, that HRTF are generally well modeled as minimum-phase systems. Designing object simulations from minimum-phase data will better exploit the nature of the recursive filter structure, both in terms of the number of state variables required (i.e., the required order of the filter), and in terms of the performance that projection models will exhibit in providing time-varying coefficient vectors that enable accurate yet smooth modulations in the resulting time-varying behavior of an object simulation.

Step 1. The first step consists in defining or estimating a set of eigenvalues for the recursive filter. In general, recursive filters that simulate systems whose impulse responses are real-valued may present real eigenvalues and/or complex eigenvalues, with complex eigenvalues coming in complex-conjugate pairs. Although eigenvalues could be arbitrarily defined to tailor or constrain a desired behavior for the frequency response of the filter (e.g., by spreading eigenvalues over the complex disc to prescribe representative frequency bands), here we assume that the eigenvalues are estimated from a set of target minimum-phase responses which are representative of the input-output behavior for the object. First, the input and/or output coordinate space needs to be defined for the reception and/or emission of sound signals for an object. Then, a total $P_T \times Q_T$ input-output impulse or frequency responses are generated or measured, with $P_T$ being the total number of points or regions of the input coordinate space to be represented in the simulation, and $Q_T$ being the total number of points or regions of the output coordinate space to be represented in the simulation. Accordingly, a vector of one or more input coordinates and a vector of one or more output coordinates will be associated with each response, with each vector encoding the represented point or region of the input coordinate and output coordinate space respectively. Then, after conversion to minimum-phase, system identification techniques (e.g., as described in Ljung, L. "System Identification: Theory for the User," Second edition, PTR Prentice Hall, Upper Saddle River, N J, 1999, or in Söderström, T. et al. "System Identification," Prentice Hall International, London, 1989) can be used to estimate a suitable set of M eigenvalues. In some cases object simulations will be designed with a focus on sound emission and present recursive filters with single or non-mutable inputs (see for example the embodiments illustrated in FIG. 5 and FIG. 6); in those cases no input space of coordinates will be explicitly needed, and $P_T$ will normally be much smaller than $Q_T$. In other cases object simulations will be designed with a focus on sound reception and present recursive filters with single or non-mutable outputs (see for example the embodiments illustrated in FIG. 7 and FIG. 8); in those cases there no output space of coordinates will be explicitly needed, and $P_T$ will normally be much larger than $Q_T$ The order of the system should be decided by accounting for an appropriate compromise between computational cost and response approximation. To reduce computational complexity, a suitable subset of responses may be selected from the total $P_T \times Q_T$ responses for the purpose of eigenvalue identification only. Also, given the decreasing frequency resolution in human hearing at higher frequencies, a preferred choice that will often procure effective simulation means is the use of perceptually-motivated frequency axes to impose warped or logarithmic frequency resolutions and thus reduce the required order for the filter of an object without affecting the perceived quality. For the case of identifying eigenvalues from a set responses, a preferred approach based on bilinear frequency warping comprises three steps: warping target responses (see, for instance, the methods evaluated by Smith et al. in "Bark and ERB bilinear transforms," *IEEE Transactions on Speech and Audio Processing*, Vol. 7:6, November 1999), estimating eigenvalues, and dewarping eigenvalues.

Step 2. The second step consists in using the M estimated eigenvalues and the totality of $P_T \times Q_T$ responses to estimate the input matrix B and output matrix C of a classic, fixed-size, time-invariant state-space filter with no forward term: the input matrix B will have size $P_T \times M$, while the output matrix will have size $M \times Q_T$. Plenty of techniques are available in the literature for solving this problem, and it is generally posed as an error matrix minimization problem. Note that in cases where both $P_T$ and $Q_T$ are large, it might sometimes be necessary to introduce geometric eigenvalue multiplicities; however more often than not one will be designing emission-only objects with $P_T=1$ or $P_T$. $Q_T$ and non-mutable input simulation, or reception-only objects with $Q_T=1$ or $P_T \gg Q_T$ and non-mutable output simulation.

Step 3. Finally, the third step consists in using the obtained input matrix B and/or the obtained output matrix C to construct input projection models for mutability of inputs, and/or output projection models for mutability of outputs. Each row of matrix B or each column of matrix C will respectively present an associated vector of input coordinates or an associated vector of output coordinates. Each p-th point or region in the input space of a sound-receiving object will be represented by a p-th corresponding pair of vectors: a p-th vector of input projection coefficients (the p-th row vector of matrix B) and a p-th vector of input coordinates (the vector of input coordinates associated with the p-th row vector of matrix B). Accordingly, each q-th point or region in the output space of a sound-receiving object will be represented by a q-th corresponding pair of vectors: a q-th vector of output projection coefficients (the q-th column vector of matrix B) and a q-th vector of output coordinates (the vector of output coordinates associated with the q-th column vector of matrix B). In essence, data-driven construction of input projection models allows to transform the collection of $P_T$ vector pairs describing the sound reception characteristics of an object into continuous functions over the space of input coordinates of the object (see Equation (2)). Accordingly, data-driven construction of output projection models allows to transform the collection of $Q_T$ vector pairs describing the sound emission characteristics of an object into continuous functions over the space of output coordinates of the object (see Equation (3)). This allows having a continuous, smooth time-update of projection coefficients while, for instance, simulated objects change positions or orientations. Notwithstanding the possibility of formulating projection models by way of elaborate modeling methods (e.g., parametric models employing basis functions of different kinds), interpolation of known coefficient vectors may remain cost-effective in many cases because only look-up tables are needed.

Example Object Simulations

To illustrate the construction of projection models and to provide simple examples of sound object simulations, we employ an exemplary embodiment of the inventive system which considers a three-dimensional spatial domain where sound wavefronts radiated from a source object propagate in any outward direction from a sphere representing the object. The direction of wavefront emission by the source is encoded by two angles in constant-radius spherical coordinates. An analogous assumption is made for a receiver object: sound wavefronts are received from any direction, encoded by two spherical coordinate angles. We choose an acoustic violin as the source object, restricting the output coordinate space to a two-dimensional coordinate system for modeling direction-directivity in terms of the frequency response of emitted wavefronts. We choose a human body HRTF as the receiver object, analogously restricting the input coordinate space to a two-dimensional coordinate system space for modeling direction-directivity in terms of the frequency response of received wavefronts. Though not illustrated here for brevity, other input or output coordinates could be included in sound object simulations, e.g. coordinates related to distance or occlusion.

In an acoustic violin the bridge transfers the energy of the vibrating strings to the body, which acts as a radiator of rather complex frequency-dependent directivity patterns. An acoustic violin was measured in a low-reflectivity chamber, exciting the bridge with an impact hammer and measuring the sound pressure with a microphone array. The transversal horizontal force exerted on the bass-side edge of the bridge was measured, and defined as the only input of the sound-emitting object. As for the output, the resulting sound pressure signals were measured at 4320 positions on a centered spherical sector surrounding the instrument, with a radius of 0.75 meters from a chosen center coinciding with the middle point between the bridge feet. The spherical sector being modeled covered approximately 95% of the sphere. Each measurement position corresponds to a pair of angles $(\theta,\varphi)$ in the vertical polar convention, representing the output coordinates on a two-dimensional rectangular grid of $60 \times 72 = 4320$ points. Such a grid represents the uniform sampling of a two-dimensional Euclidean space whose dimensions are $\theta$ and $\varphi$, with azimuth $\theta$ defined to be 0 in the direction from the string E to string G at their intersection with the bridge, and, and elevation $\varphi$ defined to be 0 in the direction perpendicular to the violin top plate. Deconvolution was used to obtain $Q_T=4320$ emission impulse response measurements, one for each force-pressure pair of signals. To design a mutable state-space filter of order M=58 for the violin, we first impose minimum-phase on all $Q_T$=4320 response measurements and use a subset of the measurements to estimate 58 eigenvalues over a warped frequency axis. We then define the input matrix of a corresponding fixed-size, classic time-invariant state-space model as a sole, length-58 vector of ones. We continue by estimating a 4320×58 output matrix by solving a least-squares minimization problem using all measurements. This matrix comprises $Q_T$=4320 vectors of output projection coefficients, with each q-th vector having M=58 coefficients. Equivalently, this can be seen as having M=58 vectors of 4320 coefficients each, with each m-th vector being associated to the m-th state variable and representing a collection of 60×72 samples of the spherical function $c_m(\theta,\varphi)$ describing the distribution of the m-th output projection coefficient $c_m$ over the two dimensional space of orientation angles $(\theta,\varphi)$.

We construct a lookup-based output projection model by spherical harmonic modeling and output coordinate space resampling as follows. First, we use all 4320 samples of each m-th spherical function $c_m(\theta,\varphi)$ and the angles correspondingly annotated for each of the 4320 orientations to obtain a truncated spherical harmonic representation of order 12. This leads to M=58 spherical harmonic models, one per state variable and eigenvalue. We proceed with defining a two-dimensional grid of 64×64=4096 orientations, with each grid position corresponding to a distinct pair of angles $(\theta,\varphi)$. We then evaluate the M spherical harmonic models at the new grid positions, leading to M tables of 64×64 positions each. We then configure our lookup-based output projection model so that it performs M bilinear interpolations for obtaining a length-M vector $\underline{c}=[c_1, \ldots, c_m, \ldots, c_M]$ of output projection coefficients given the angles $(\theta,\varphi)$ of an outgoing wavefront. Thus, here the M lookup tables constitute the output projection model K of Equation (3), the angles $(\theta,\varphi)$ constitute the vector of output coordinates for a wavefront departing from the violin simulation, and bilinear interpolation is performed by the output projection function $S^+$. In this scheme, we have used spherical harmonic modeling as a means for smoothing the distributions of projection coefficients prior to constructing tables for interpolated lookup. Note that the choices for spherical harmonic order and/or size of the lookup tables should be based on a compromise between spatial resolution and memory requirements. If constrained by memory, the stored spherical harmonic representations could instead constitute the output projection model K, which implies that the output projection function $S^+$ needs to be in charge of evaluating the spherical harmonic models given a pair of angles; this, however, incurs an additional computational cost if compared with the lookup scheme.

Figure 11A:
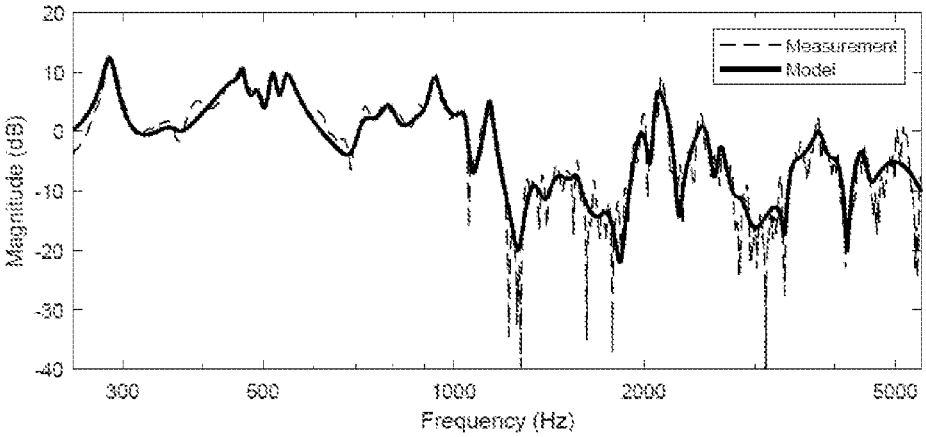
FIG. 11A depicts an example sound emission magnitude frequency response obtained for a violin object simulation that uses orientation angles as output coordinates; for comparison, the measured and modeled responses corresponding to the same orientation are overlaid.
Figure 11B:
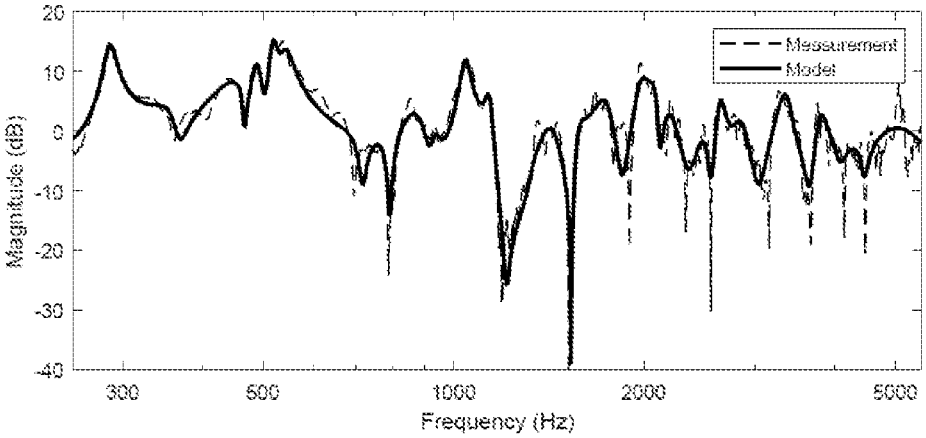
FIG. 11B depicts a further example sound emission magnitude frequency response obtained for the same violin object simulation demonstrated by FIG. 11A, this time for a different orientation.
Figure 12A:
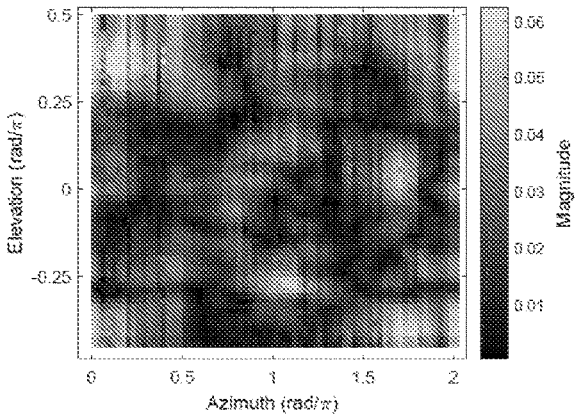
FIG. 12A depicts a table with the constant-radius spherical distribution of the magnitude of the output projection coefficient corresponding to one of the state variables comprised in the same violin object simulation demonstrated by FIG. 11A and FIG. 11B, as obtained by designing the output matrix of a classic state-space filter designed from measurements.
Figure 12B:
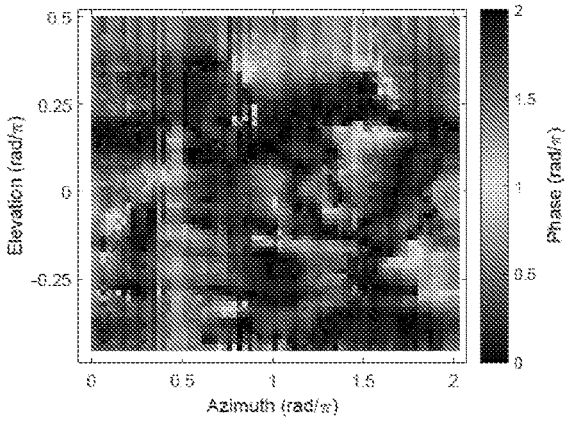
FIG. 12B depicts a table with the constant-radius spherical distribution of the phase of the same output projection coefficient for which the magnitude distribution is depicted in FIG. 12B.
Figure 12C:
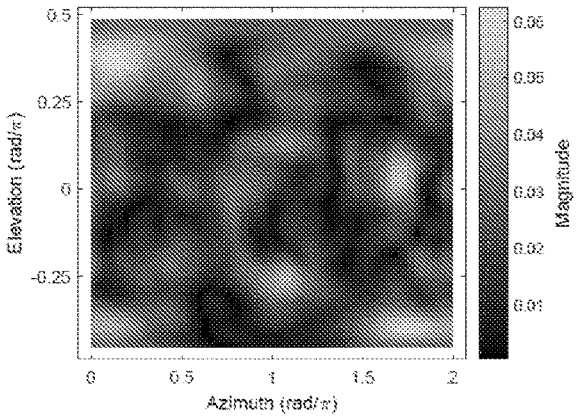
FIG. 12C depicts a table with the constant-radius spherical distribution of the magnitude of the output projection coefficient corresponding to the same state variable as depicted in FIG. 12A, but obtained by constructing a spherical harmonic model from the coefficients depicted in FIG. 12A and evaluating it at a resampled grid of orientation coordinates.
Figure 12D:
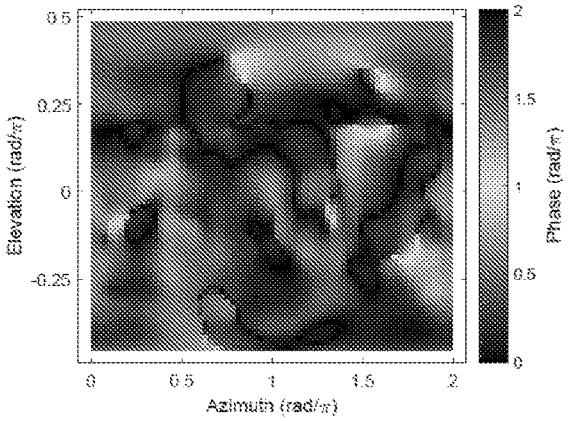
FIG. 12D depicts a table with the constant-radius spherical distribution of the phase of the same output projection coefficient for which the magnitude distribution is depicted in FIG. 12C, also obtained by evaluation of a spherical harmonic model.
Figure 13A:
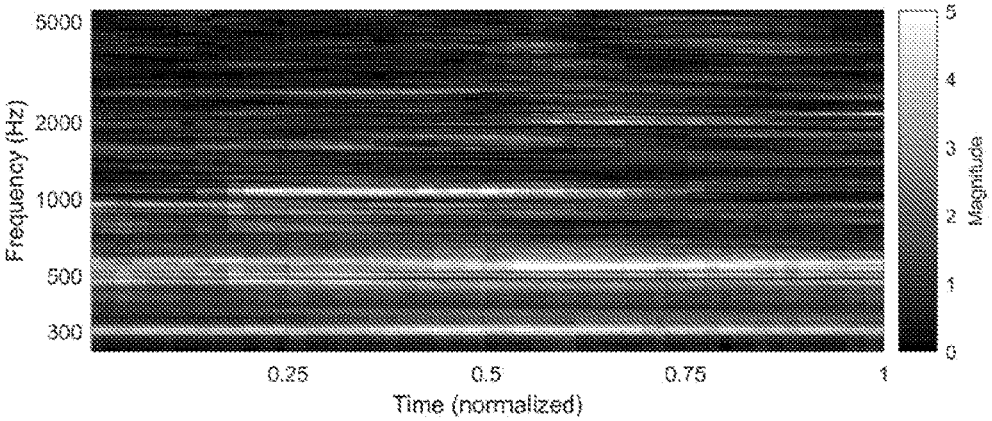
FIG. 13A demonstrates the time-varying magnitude frequency response corresponding to sound emission by a modeled violin, obtained for a time-varying orientation and nearest-neighbor response retrieval from the original set of discrete response measurements.
Figure 13B:
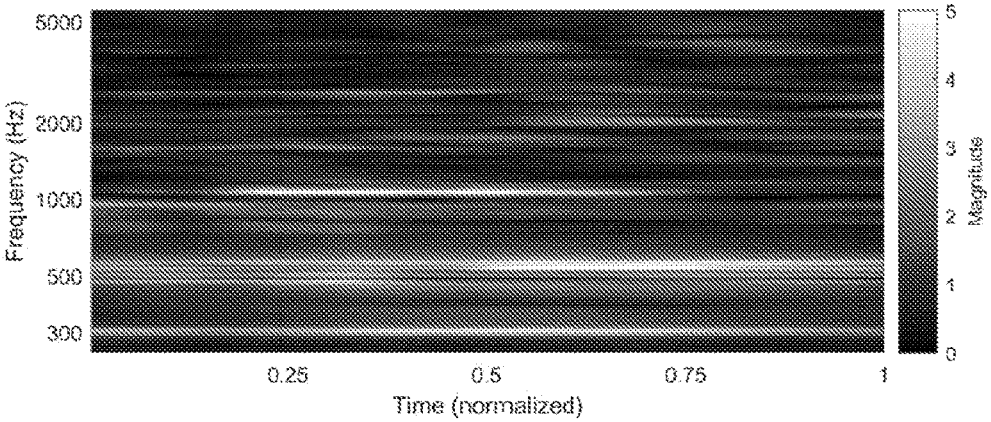
FIG. 13B demonstrates the time-varying magnitude frequency response corresponding to sound emission by the violin object simulation demonstrated in FIG. 11A and FIG. 11B, obtained for the same time-varying orientation as that illustrated in FIG. 13A but this time simulated via interpolated lookup of output projection coefficient vectors.

Two example sound emission frequency responses obtained with the described violin object simulation model are respectively displayed in FIG. 11A and FIG. 11B for two distinct orientations, along with the respective measurements as originally obtained for said orientations. Furthermore, to illustrate the construction of the output projection model, we employ FIG. 12A, FIG. 12B, FIG. 12C, and FIG. 12D to depict a comparison between the original spherical distribution as obtained for one of the M output projection coefficients (magnitude and phase respectively depicted in FIG. 12A and FIG. 12B), and the corresponding lookup table (magnitude and phase respectively depicted in FIG. 12C and FIG. 12D) obtained after spherical harmonic modeling and evaluation at a resampled grid of output coordinates. As it can be seen, spherical harmonic modeling and re-synthesis can be used as an effective preprocessing means to improving the quality of lookup tables for use in time-varying conditions. Finally, to demonstrate the behavior of the violin object simulation at run-time, we synthesize the sound emission frequency response as obtained from exciting the object simulation in time-varying conditions. For 512 consecutive steps, we modify the output coordinates of an outgoing wavefront as captured by an ideal microphone lying on the sphere surrounding the source object. Assuming ideal excitation of the violin bridge in each step, we simulate linear motion of the ideal microphone on the sphere, from initial orientation ($\theta$=0.69 rad, $\varphi$=4.71 rad) to final orientation ($\theta$=−1.48 rad, $\varphi$=−0.52 rad). This is depicted by FIG. 13A and FIG. 13B, where we compare the original frequency response measurements as accessed through nearest-neighbor by attending to orientation (FIG. 13A), and the object simulation frequency response as obtained from interpolated lookup of the output projection coefficient tables in the model (FIG. 13B).

With regards to HRTF as a receiver object simulation example, we choose a human body sitting in a chair as represented by a high-spatial resolution head-related transfer function set of the CPIC public dataset, described by Algazi et al. in "The CPIC hrtf database," *IEEE Workshop on Applications of Signal Processing to Audio and Acoustics*, October 2001. The data used for this example model comprises 1250 single-ear responses obtained from measuring the left in-ear microphone signal during excitation by a loudspeaker located at 1250 unevenly distributed positions on a head-centered spherical sector of 1-meter radius, around a dummy head subject. The spherical sector being modeled covers approximately 80% of the sphere. Each of the 1250 excitation positions corresponds to a pair of angles $(\theta,\varphi)$ in a two-dimensional space of input coordinates, expressed in the inter-aural polar convention. To design a mutable state-space filter of order M=36 for the HRTF, we first impose minimum-phase on all $P_T$=1250 response measurements and use all measurements to estimate 36 eigenvalues over a linear frequency axis. We then define the output matrix of a corresponding fixed-size, time-invariant state-space model as a sole, length-36 vector of ones. We continue by estimating a 36×1250 input matrix by solving a least-squares minimization problem using all measurements. This matrix comprises $P_T$=1250 vectors of output projection coefficients, with each p-th vector having M=36 coefficients. Equivalently, this can be seen as having M=36 vectors of 1250 entries each, with each m-th vector being associated to the m-th state variable and representing a collection of samples of the spherical function $b_m(\theta,\varphi)$ describing the distribution of the m-th input projection coefficient $b_m$ over the two dimensional space of orientation angles $(\theta,\varphi)$.

We construct a lookup-based input projection model by spherical harmonic modeling and input coordinate space resampling as follows. First, we use all 1250 samples of each m-th spherical function $b_m(\theta,\varphi)$ and the angles correspondingly annotated for each of the 1250 orientations to obtain a spherical harmonic representation of order 10. This leads to M=36 spherical harmonic models, one per state variable and eigenvalue. We proceed with defining a two-dimensional grid of 64×64 positions, with each position corresponding to a distinct pair of angles $(\theta,\varphi)$. We then evaluate the M spherical harmonic models at the new grid positions, leading to M tables of 64×64 positions each. We then configure our lookup-based input projection model to perform M bilinear interpolations to obtain one length-M vector $\underline{b}=[b_1, \ldots, b_m, \ldots, b_M]$ of input projection coefficients given the angles (θ,φ) of an incoming wavefront. Thus, here the M lookup tables constitute the input projection model V of Equation (2), the angles (θ,φ) constitute the vector β of output coordinates for a wavefront being received by the HRTF simulation, and bilinear interpolation is performed by the input projection function $S^-$. As with the violin, here we have used spherical harmonic modeling as a means for re-synthesizing the distributions of projection coefficients prior to constructing tables for interpolated lookup. Again, the choices for spherical harmonic order and/or size of the lookup tables should be based on a compromise between spatial resolution and memory requirements. Analogously to the source object case, the stored spherical harmonic representations could instead constitute the output projection model V, which implies that the output projection function $S^-$ needs to be in charge of evaluating the spherical harmonic models given a pair of angles.

Note that, in the context of binaural rendering, two collocated HRTF receiver object models similar to the one described here can be used, one for each ear. In such context, given that object simulations are obtained from minimum-phase data, excess-phase can be modeled in terms of pure delay by accounting for interaural time differences.

Figure 14A:
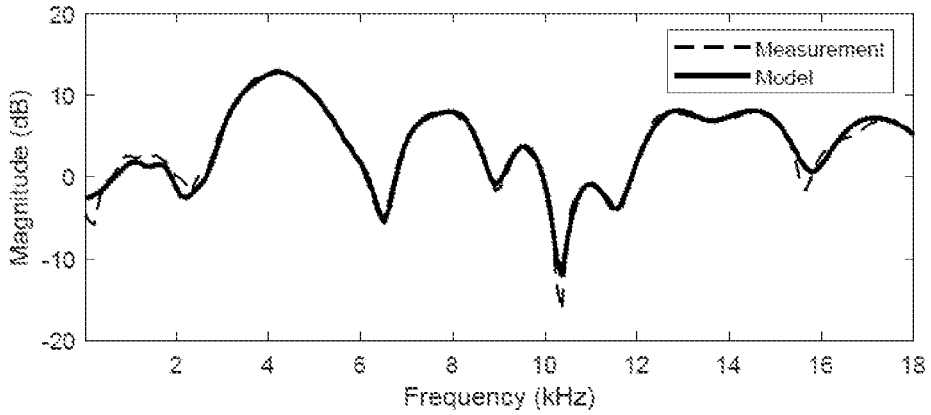
FIG. 14A depicts an example sound reception magnitude frequency response obtained for the left ear of an HRTF receiver object simulation that uses orientation angles as input coordinates; for comparison, the measured and modeled responses corresponding to the same orientation are overlaid.
Figure 14B:
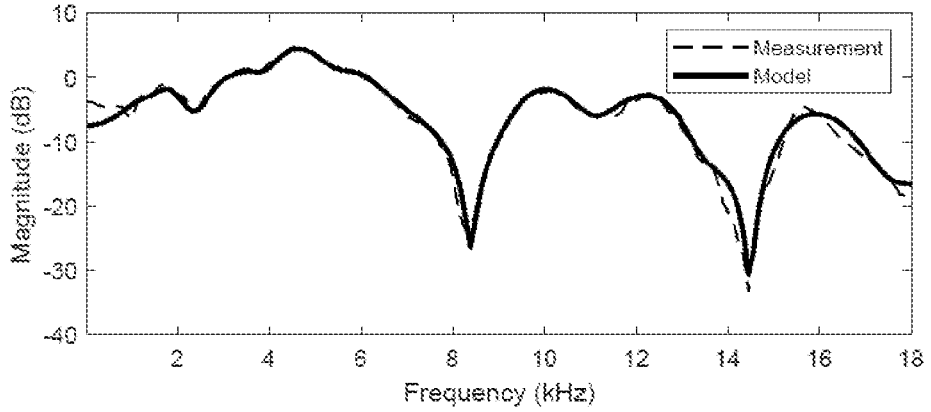
FIG. 14B depicts a further example sound reception magnitude frequency response obtained for the same HRTF receiver object simulation demonstrated by FIG. 14A, this time for a different orientation.
Figure 15A:
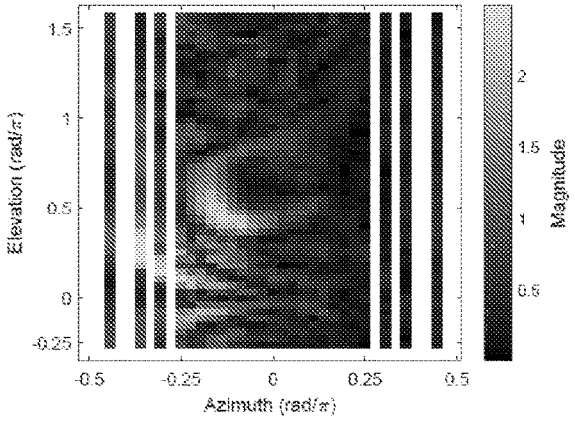
FIG. 15A depicts a table with the constant-radius spherical distribution of the magnitude of the input projection coefficient corresponding to one of the state variables comprised in the same HRTF receiver object simulation demonstrated by FIG. 14A and FIG. 14B, as obtained by designing the input matrix of a classic state-space filter designed from measurements.
Figure 15B:
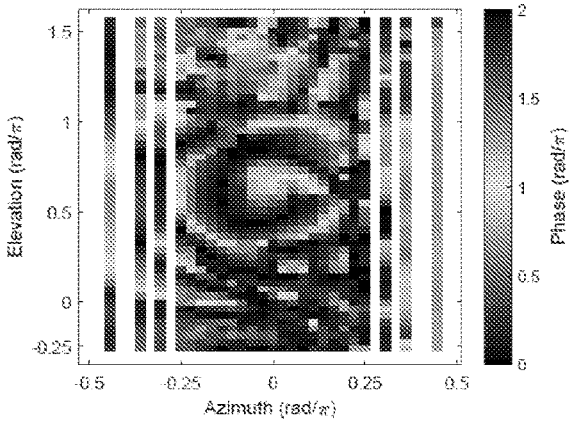
FIG. 15B depicts a table with the constant-radius spherical distribution of the phase of the same input projection coefficient for which the magnitude distribution is depicted in FIG. 15A.
Figure 15C:
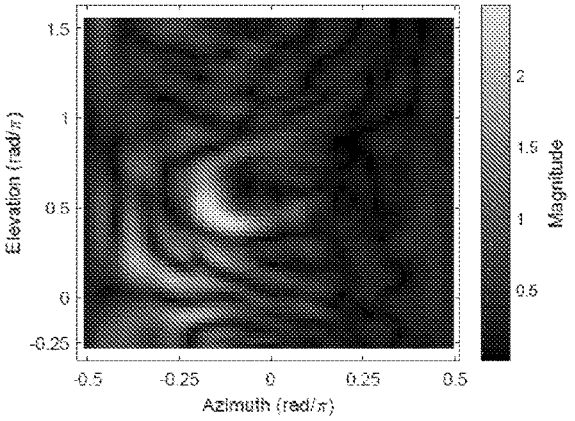
FIG. 15C depicts a table with the constant-radius spherical distribution of the magnitude of the input projection coefficient corresponding to the same state variable as depicted in FIG. 15A, but obtained by constructing a spherical harmonic model from the coefficients depicted in FIG. 15A and evaluating it at a resampled grid of orientation coordinates.
Figure 15D:
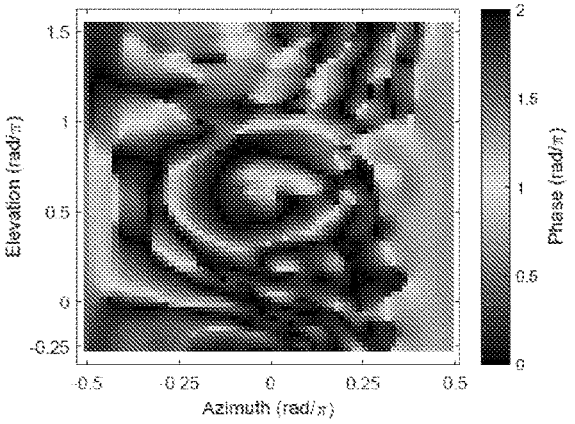
FIG. 15D depicts a table with the constant-radius spherical distribution of the phase of the same input projection coefficient for which the magnitude distribution is depicted in FIG. 15C, also obtained by evaluation of a spherical harmonic model.
Figure 16A:
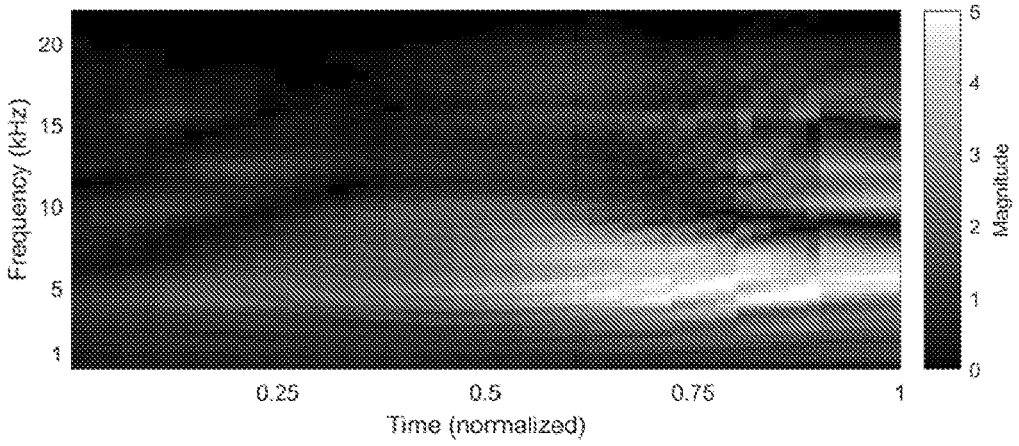
FIG. 16A demonstrates the time-varying magnitude frequency response corresponding to sound reception by the left ear of a modeled HRTF, obtained for a time-varying orientation and nearest-neighbor response retrieval from the original set of discrete response measurements.
Figure 16B:
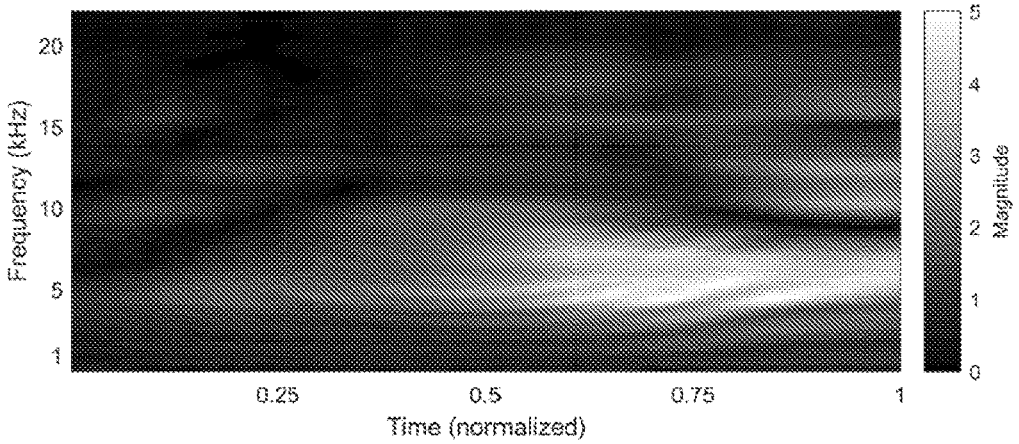
FIG. 16B demonstrates the time-varying magnitude frequency response corresponding to sound reception by the HRTF receiver object simulation demonstrated in FIG. 14A and FIG. 14B, obtained for the same time-varying orientation as that illustrated in FIG. 16A but this time simulated via interpolated lookup of output projection coefficient vectors.

Two example sound reception frequency responses obtained with the described HRTF object simulation are respectively displayed in FIG. 14A and FIG. 14B for two distinct orientations, along with the respective measurements as originally obtained for said orientations. Furthermore, to illustrate the construction of the input projection model, we employ FIG. 15A, FIG. 15B, FIG. 15C, and FIG. 15D to depict a comparison between the original spherical distribution as obtained for one of the M input projection coefficients (magnitude and phase respectively depicted in FIG. 15A and FIG. 15B), and the corresponding lookup table (magnitude and phase respectively depicted in FIG. 15C and FIG. 15D) obtained after spherical harmonic modeling and evaluation at a resampled grid of output coordinates. Here, spherical harmonic modeling and re-synthesis was also used to obtain input projection coefficients for missing regions of the input coordinate space: the original measurements were taken at unevenly spread orientations in the interaural polar convention, and the lookup table is filled at evenly spaced angles. Finally, to demonstrate the behavior of the HRTF object simulation at run-time, we synthesize the sound reception frequency response as obtained from exciting the object simulation in time-varying conditions. For 512 consecutive steps, we modify the input coordinates of an incoming wavefront as emitted by an ideal source lying on the sphere surrounding the receiver object. We then simulate linear motion of the ideal source on the sphere, again from initial orientation (θ=0.69 rad, φ=4.71 rad) to final orientation (θ=−1.48 rad, φ=−0.52 rad). This is depicted by FIG. 16A and FIG. 16B, where we compare the original frequency response measurements as accessed through nearest-neighbor by attending to orientation (FIG. 16A), and the object simulation frequency response as obtained from interpolated lookup of the input projection coefficient tables in the model (FIG. 16B).

Order Selection

Figure 17B:
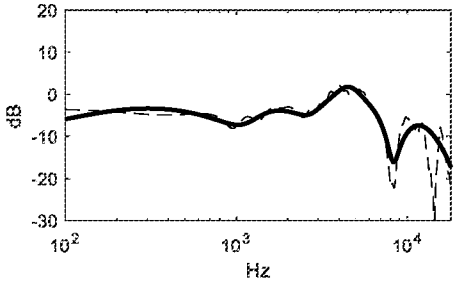
FIG. 17B depicts the left ear magnitude frequency response of the same modeled HRTF for the same orientation as depicted in FIG. 17A, obtained for a receiver object simulation of order 8 but designed over a Bark frequency axis (solid line), along with the corresponding original measurement (dashed line).
Figure 17A:
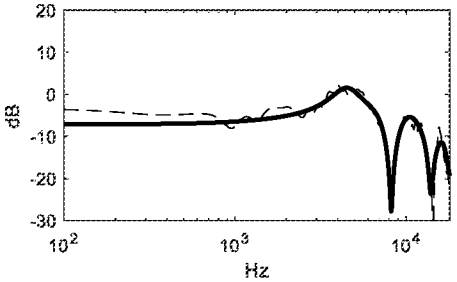
FIG. 17A depicts the left ear magnitude frequency response of a modeled HRTF for a given orientation as obtained for a receiver object simulation of order 8 designed over a linear frequency axis (solid line), along with the corresponding original measurement (dashed line).
Figure 17D:
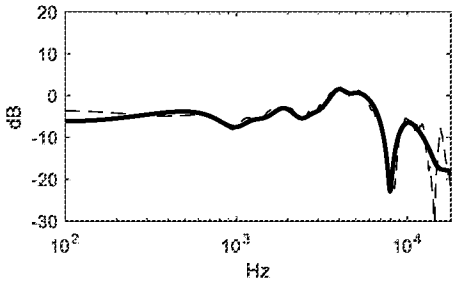
FIG. 17D depicts the left ear magnitude frequency response of the same modeled HRTF for the same orientation depicted in FIG. 17A, obtained for a receiver object simulation of order 16 but designed over a Bark frequency axis (solid line), along with the corresponding original measurement (dashed line).
Figure 17C:
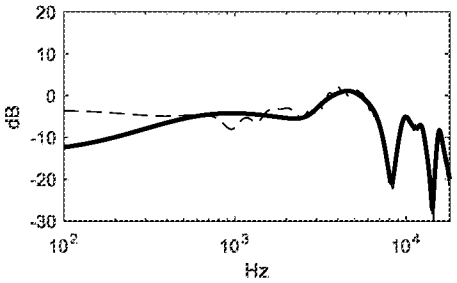
FIG. 17C depicts the left ear magnitude frequency response of the same modeled HRTF for the same orientation depicted in FIG. 17A, obtained for a receiver object simulation of order 16 designed over a linear frequency axis (solid line), along with the corresponding original measurement (dashed line).
Figure 17F:
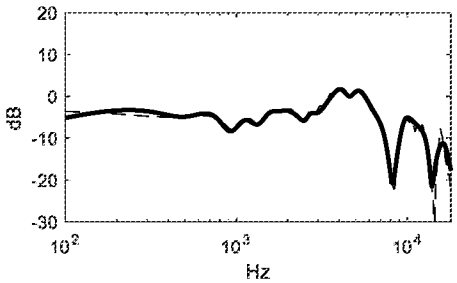
FIG. 17F depicts the left ear magnitude frequency response of the same modeled HRTF for the same orientation depicted in FIG. 17A, obtained for a receiver object simulation of order 32 but designed over a Bark frequency axis (solid line), along with the corresponding original measurement (dashed line).
Figure 17E:
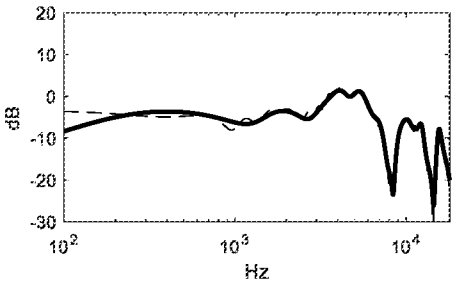
FIG. 17E depicts the left ear magnitude frequency response of the same modeled HRTF for the same orientation depicted in FIG. 17A, obtained for a receiver object simulation of order 32 designed over a linear frequency axis (solid line), along with the corresponding original measurement (dashed line).
Figure 18A:
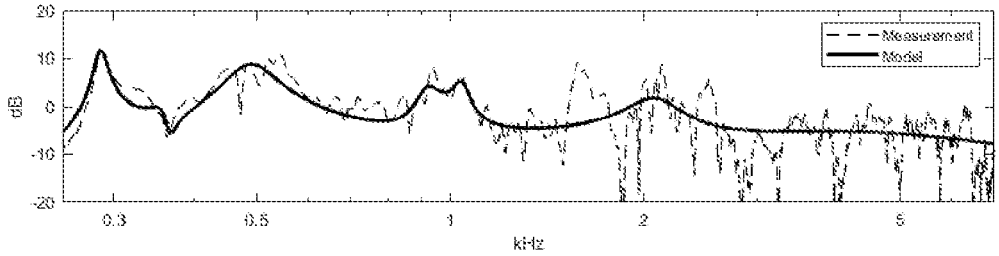
FIG. 18A depicts the magnitude frequency response of a modeled violin for a given orientation as obtained for a source object simulation of order 14 designed over a Bark frequency axis (solid line), along with the corresponding original measurement (dashed line).
Figure 18B:
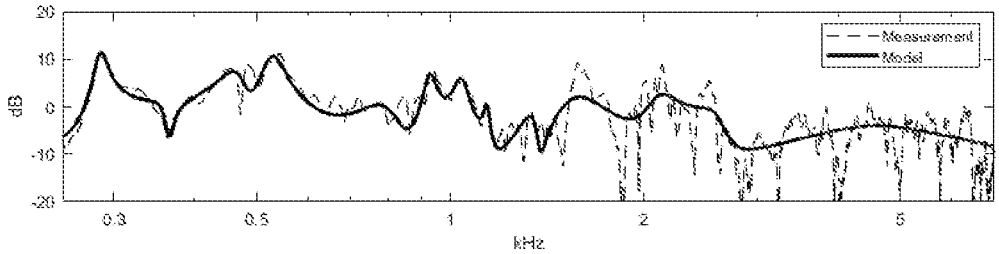
FIG. 18B depicts the magnitude frequency response of the same modeled violin and orientation as depicted in FIG. 18A, obtained for a source object simulation of order 26 designed over a Bark frequency axis (solid line), along with the corresponding original measurement (dashed line).
Figure 18C:
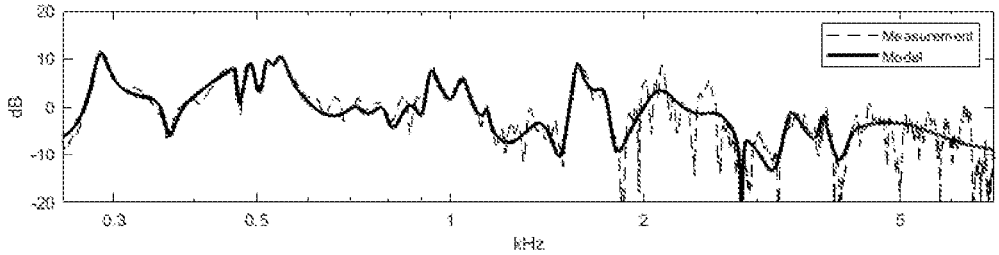
FIG. 18C depicts the magnitude frequency response of the same modeled violin and orientation as depicted in FIG. 18A, obtained for a source object simulation of order 40 designed over a Bark frequency axis (solid line), along with the corresponding original measurement (dashed line).
Figure 18D:
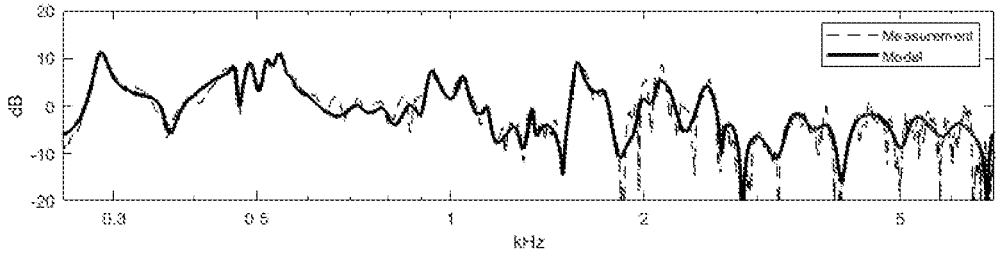
FIG. 18D depicts the magnitude frequency response of the same modeled violin and orientation as depicted in FIG. 18A, obtained for a source object simulation of order 58 designed over a Bark frequency axis (solid line), along with the corresponding original measurement (dashed line).

Though the demonstrated exemplary object simulations have been picked to demonstrate the effectiveness of the inventive system in accurately simulating highly-directive sound objects while ensuring smoothness under interactive operation, practitioners of the invention will decide the recursive filter order M of an object simulation by finding an adequate compromise between desired accuracy and computational cost. As priorly indicated, the use of warped frequency axes during the design of object simulations can be used to reduce the order required for a filter to provide satisfactory modeling accuracies over perceptually-motivated frequency resolutions. To demonstrate this practice of the invention, six example sound reception frequency responses are depicted in FIG. 17A through FIG. 17F as obtained for order variations and frequency warping variations of the previously described HRTF receiver object simulation, all for the same wavefront direction. FIG. 17A, FIG. 17B, and FIG. 17C correspond to object simulations designed over a linear frequency axis, with orders M=8, M=16, and M=32 respectively. Conversely, FIG. 17B, FIG. 17D, and FIG. 17E correspond to object simulations designed over a warped frequency axis under a Bark-bilinear transform, with orders M=8, M=16, and M=32 respectively. In the same manner, an appropriate order may be selected for designing source object simulations. We illustrate this by depicting four violin emission frequency responses in FIG. 18A through FIG. 18.*d*, obtained for the same orientation but employing object simulations designed on a warped frequency axis for four different orders: FIG. 18A corresponds to M=14, FIG. 18B corresponds to M=26, FIG. 18.C corresponds to M=40, and FIG. 18D corresponds to M=58. As it can be seen, the use of perceptually-motivated frequency axes can help ensure acceptable modeling accuracy for low-frequency spectral cues across different filter orders.

Figure 19:
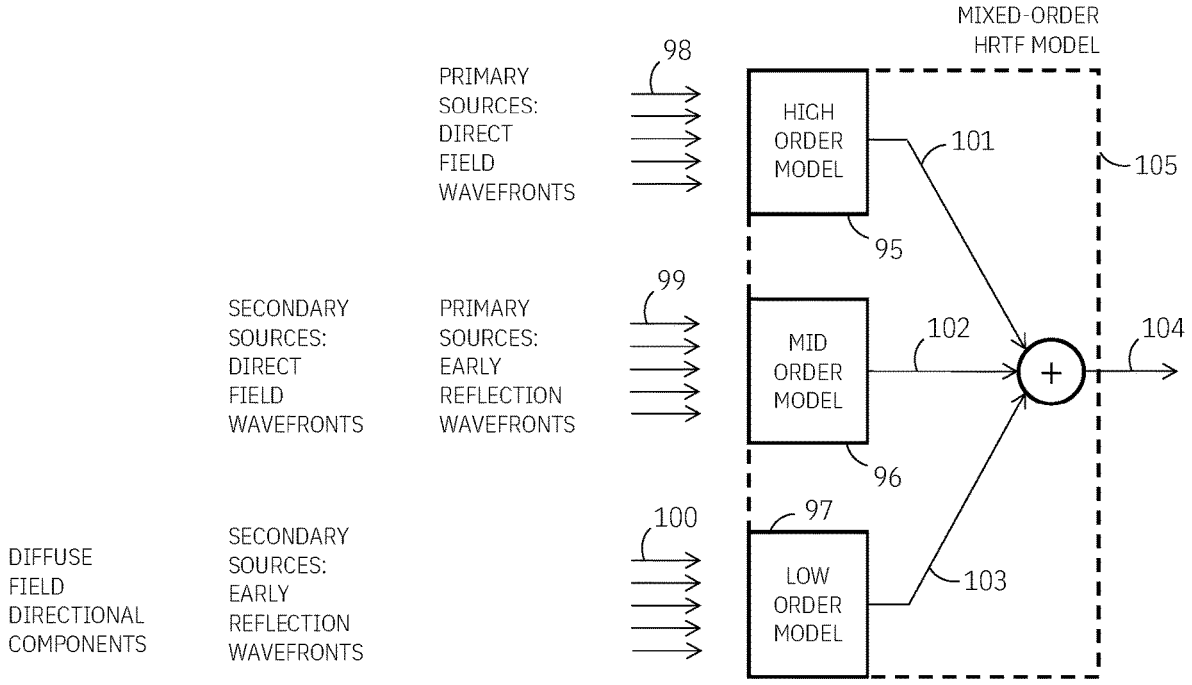
FIG. 19 is a block diagram schematically representing a single-ear, mixed-order HRTF simulation constructed from three individual HRTF simulations each of different order.

In certain embodiments of the inventive system it may be convenient to construct mixed-order object simulations as superpositions of single-order object simulations. For example, this can be used to feature the perceptual auditory relevance of direct-field wavefronts versus that of early reflection or diffuse field directional components: ranking of wavefronts depending on reflection order or on a given importance granted to some sound sources can help choosing among object simulations in mixed-order embodiments, with the ultimate aim of reducing the required resources while maintaining a desired perceptual accuracy. An example of such embodiment is schematically depicted in FIG. 19 for a single-ear HRTF mixed-order simulation assembled by superposition of three single-order receiver object simulations. In the illustrated example, one single-order HRTF object simulation 95 of higher order (e.g., M=32) is used for modeling the reception of direct-field wavefronts 98 arriving from sound sources of primary importance; one single-order HRTF object simulation 96 of middle order (e.g., M=16) is used for joint modeling of the reception of early reflections of wavefronts 99 emitted by sound sources of secondary importance for the rendering, and the reception of direct-field wavefronts 99 arriving from sound sources of secondary importance for the rendering; and finally one single-order HRTF object simulation 97 of lower order (e.g., M=8) is used for joint modeling of the reception of early reflections of wavefronts 100 emitted by sound sources of secondary importance for the rendering, and the reception of diffuse-field directional components 100. The output 101 of the higher order object 95, the output 102 of the middle order object 96, and the output 103 of the lower order object 97 are all summed to obtain a combined output 104 for the mixed-order HRTF object simulation 105. Note that mixed-order simulation can be analogously practiced to the case of sound source objects.

Figure 20A:
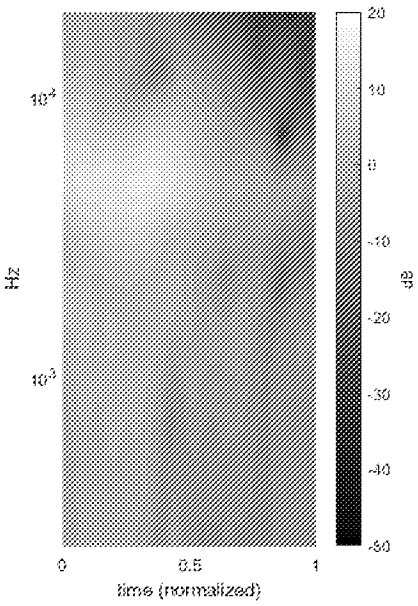
FIG. 20A depicts the time-varying magnitude frequency response corresponding to sound reception by a left-ear HRTF receiver object simulation of order 8, obtained for a time-varying orientation and simulated via interpolated lookup of input projection coefficient vectors.
Figure 20B:
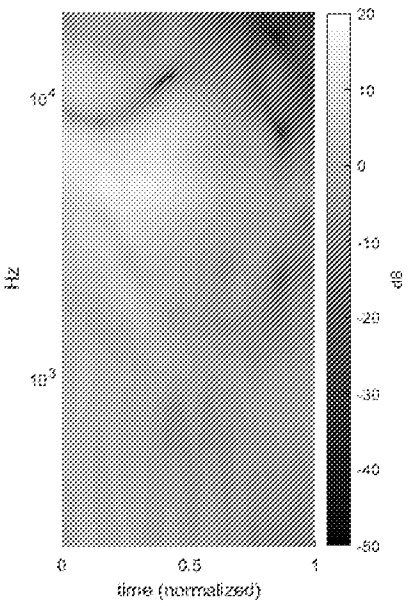
FIG. 20B depicts the time-varying magnitude frequency response corresponding to sound reception by a left-ear HRTF receiver object simulation similar to that of FIG. 20A, this time of order 16.
Figure 20C:
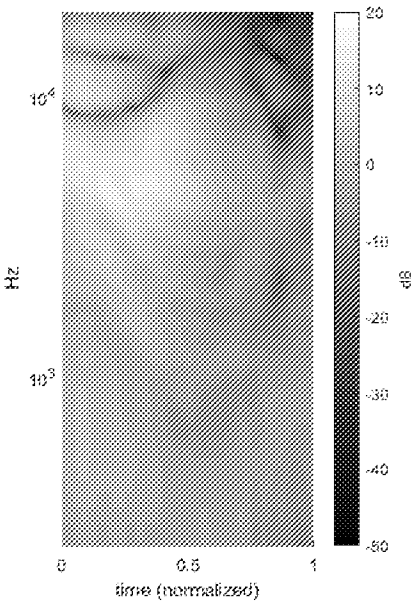
FIG. 20C depicts the time-varying magnitude frequency response corresponding to sound reception by a left-ear HRTF receiver object simulation similar to that of FIG. 20B, this time of order 32.
Figure 20D:
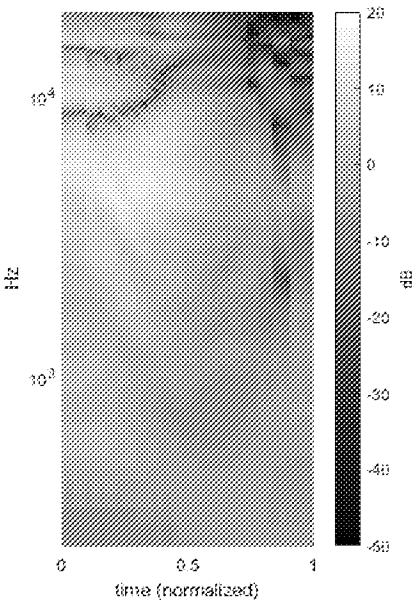
FIG. 20D depicts the time-varying magnitude frequency response corresponding to sound reception by the left-ear HRTF whose measurements were used to construct the object simulations demonstrated in FIG. 20A, FIG. 20A, and FIG. 20C, for the same time-varying orientation but obtained via nearest-neighbor response retrieval from the original set of discrete response measurements.

We use logarithmic and magnitude axes to illustrate in FIG. 20A through FIG. 20D a mixed-order HRTF object simulation in time-varying conditions. We synthesize the sound reception frequency response as obtained from exciting three single-order object simulations by an ideal moving source, similarly as in FIG. 16A and FIG. 16B. All three objects were designed on a Bark frequency axis, with FIG. 20A depicting the time-varying response corresponding to the lower-order object (M=8), FIG. 20B showing the middle-order object (M=16), and FIG. 20C showing the higher-order object (M=32). For reference, in FIG. 20D we show the original frequency response measurements as accessed through nearest-neighbor under the same time-varying orientation conditions.

Real Parallel Recursive Filter Representation

For reasons of performance or implementation simplicity, those skilled in the art may choose to apply a convenient similarity transformation to the classic state-space representation of a real-valued dynamical system so that it gets expressed in real modal form while presenting the same input-output behavior. This transformation leads to changes in the transition matrix and in the input and/or output matrix. First, this will lead to having a real-valued transition matrix in block-diagonal form where the diagonal comprises single diagonal elements and 2×2 blocks. Second, this will lead to having real-valued input and/or output matrices, and therefore only real coefficients will appear in the vectors comprised therein. In such a context, a time-invariant multiple-input, multiple-output state-space filter can be transformed into an equivalently structure formed by a parallel combination of first- and/or second-order recursive filters where no complex-value operations are required. Accordingly, certain embodiments of the inventive time-varying system will also enable realizations where only real-valued operations are required. Without loss of generality we describe here two simple, non-limiting embodiments that make use of a real parallel recursive filter representation involving order-1 and order-2 filters.

Figure 21:
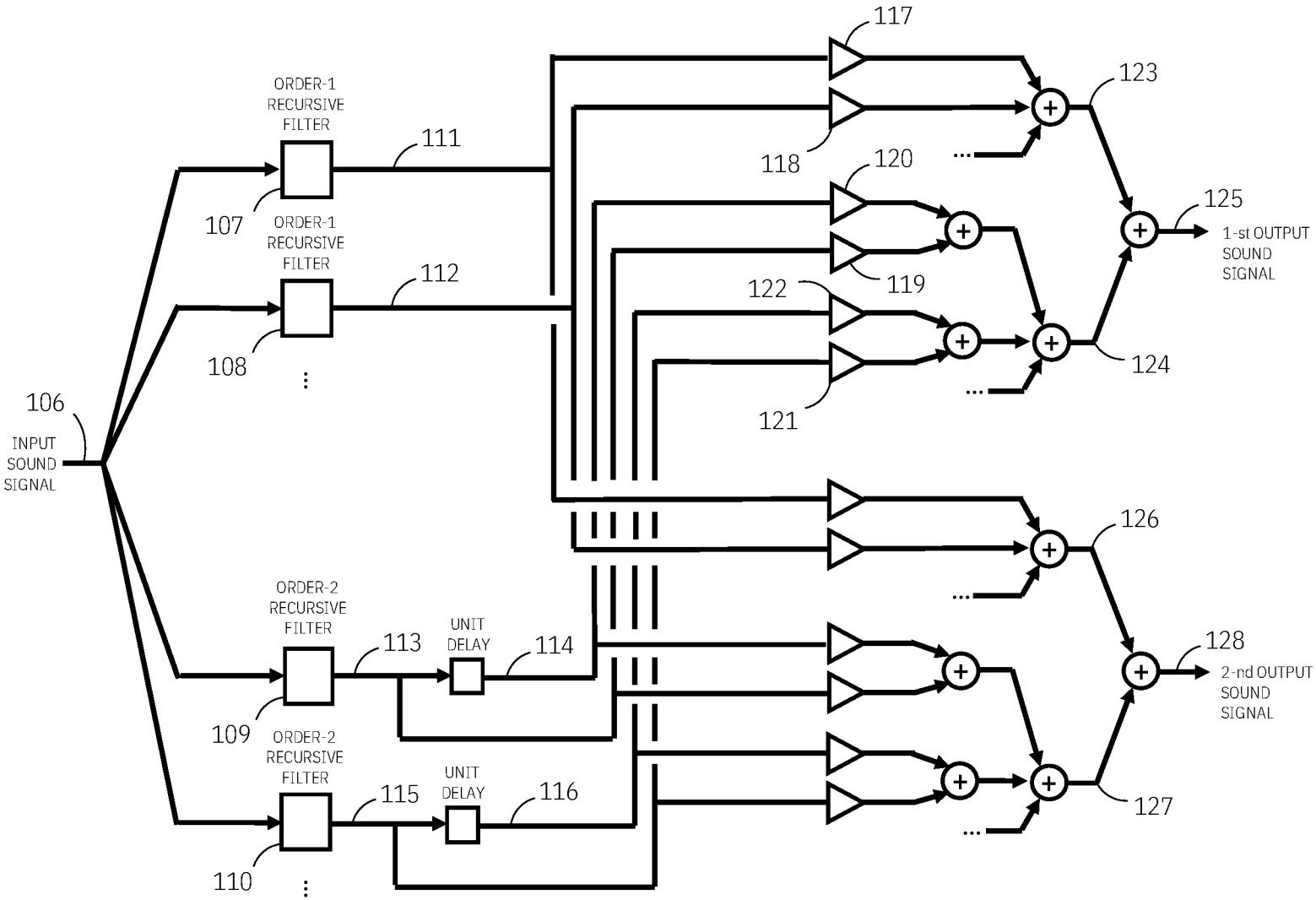
FIG. 21 is a block diagram illustrating an example embodiment of a time-varying recursive structure for simulating a sound-emitting object, similar to that depicted in FIG. 6, but employing a real parallel recursive form representation.

First, one preferred embodiment of a real recursive parallel representation of the inventive system where a source object simulation presents one single non-mutable input and a time-varying number of mutable outputs is schematically represented in FIG. 21. Note that only two outputs, two order-1 recursive filters, and two order-2 recursive filters are illustrated for clarity, but the nature of the structure would remain analogous for any number of order-1 recursive filters or order-2 recursive filters, and any time-varying number of outputs. The input sound signal 106 is fed into both order-1 recursive filters 107 and 108, as well as into both order-2 recursive filters 109 and 110. In relation to an equivalent, mutable state-space filter in complex modal form (i.e., diagonal transition matrix) presenting two outputs $y^1[n]$ and $y^2[n]$, the order-1 recursive filter 107 performs a first-order recursion involving the real eigenvalue $\lambda_{r1}$ of the transition matrix, and the order-1 recursive filter 108 performs a first-order recursion involving the real eigenvalue $\lambda_{r2}$ of the transition matrix. Accordingly, the order-2 recursive filter 109 performs a second-order recursion involving real coefficients obtained from the pair of complex-conjugate eigenvalues $\lambda_{c1}$ and $\lambda_{c1}$* of the transition matrix, and the order-2 recursive filter 110 performs a second-order recursion involving real coefficients obtained from the pair of complex-conjugate eigenvalues $\lambda_{c2}$ and $\lambda_{c2}$* of the transition matrix. This leads to two first-order-filtered signals 111 and 112, and two second-order-filtered signals 113 and 115. The first emitted output sound signal $y^1[n]$, 125, will be obtained by adding a time-varying linear combination 123 of first-order-filtered signals 111 and 112 and a time-varying linear combination 124 of second-order-filtered signals 113 and 115 and unit-delayed versions 114 and 116 of the second-order-filtered signals 113 and 115. Departing from the time-varying output projection vectors $\underline{c}^1[n]$ and $\underline{c}^2[n]$ of an equivalent, mutable state-space filter in complex modal form (i.e., diagonal transition matrix), it should be straightforward for those skilled in the art to deduce: (a) the time-varying weights 117 and 118 respectively involved in linearly combining signals 111 and 112, and (b) the time-varying weights 119, 120, 121, and 122 respectively involved in linearly combining signals 113, 114, 115, and 116. Accordingly, the second emitted output sound signal $y^2[n]$, 128, will be obtained by adding a time-varying linear combination 126 of the first-order-filtered signals 111 and 112 and a time-varying linear combination 127 of second-order-filtered signals 113 and 115 and unit-delayed versions 114 and 116 of the second-order-filtered signals 113 and 115.

Figure 22:
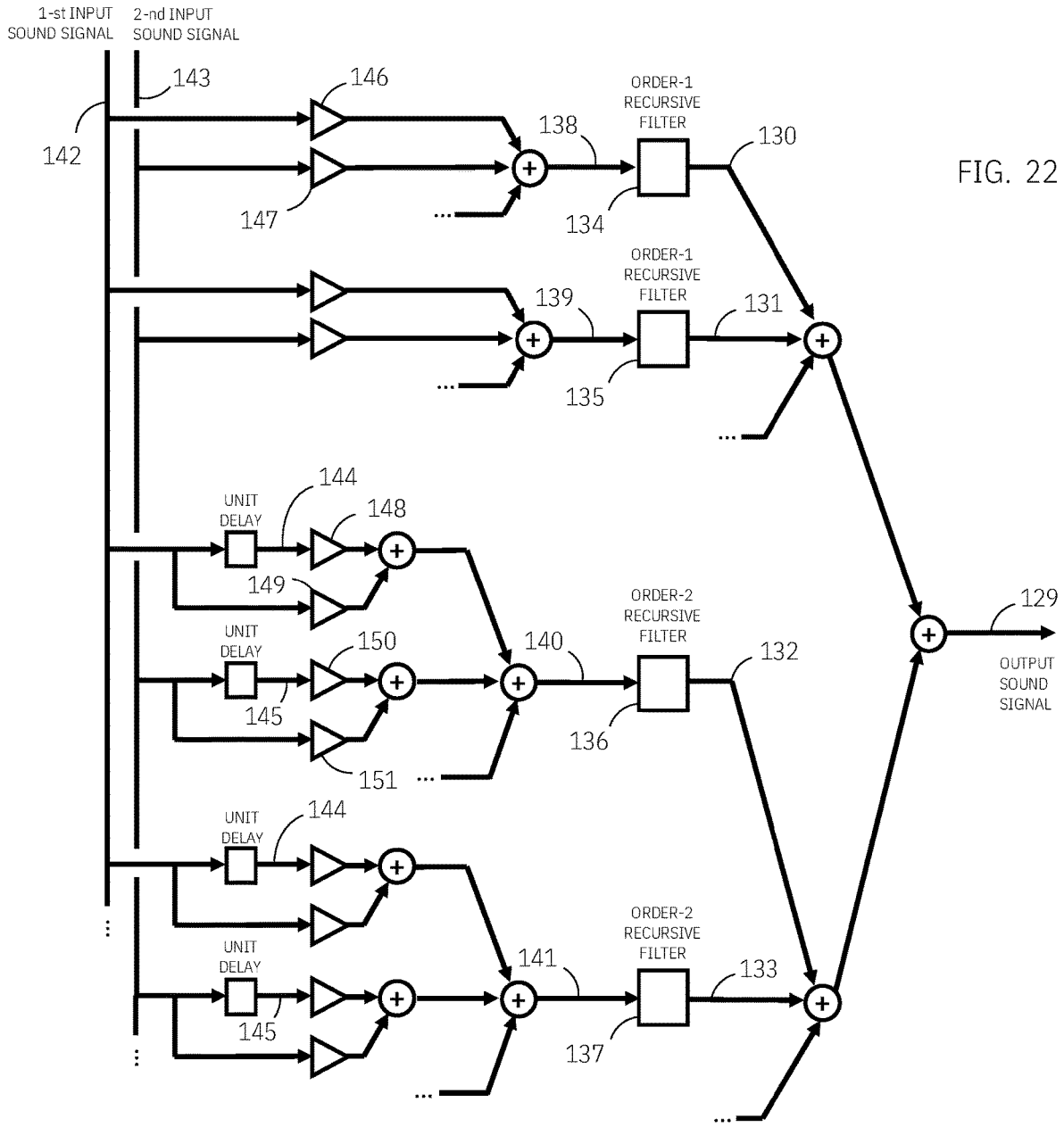
FIG. 22 is a block diagram illustrating an example embodiment of a time-varying recursive structure for simulating a sound-receiving object, similar to that depicted in FIG. 8, but employing a real parallel recursive form representation.

Second, one preferred embodiment of a real recursive parallel representation of the inventive system where a receiver object simulation presents one single non-mutable output and a time-varying number of mutable inputs is schematically represented in FIG. 22. Note that only two inputs, two order-1 recursive filters, and two order-2 recursive filters are illustrated for clarity, but the nature of the structure would remain analogous for any number of order-1 recursive filters or order-2 recursive filters, and any time-varying number of inputs. The output sound signal 129 is obtained by summing two first-order-filtered signals 130 and 131 respectively obtained from the outputs of two order-1 recursive filters 134 and 135, and two second-order-filtered signals 132 and 133 respectively obtained from the outputs of two order-2 recursive filters 136 and 137. In relation to an equivalent, mutable state-space filter in complex modal form (i.e., diagonal transition matrix) presenting two inputs $x^1[n]$ and $x^2[n]$, the order-1 recursive filter 134 performs a first-order recursion involving the real eigenvalue $\lambda_{r1}$ of the transition matrix, and the order-1 recursive filter 135 performs a first-order recursion involving the real eigenvalue $\lambda_{r2}$ of the transition matrix. Accordingly, the order-2 recursive filter 136 performs a second-order recursion involving real coefficients obtained from the pair of complex-conjugate eigenvalues $\lambda_{c2}$ and $\lambda_{c2}$* of the transition matrix, and the order-2 recursive filter 137 performs a second-order recursion involving real coefficients obtained from the pair of complex-conjugate eigenvalues $\lambda_{c2}$ and $\lambda_{c2}$* of the transition matrix. The input 138 of the order-1 recursive filter 134 is obtained as a time-varying linear combination of the two input signals 142 and 143, while the input 140 of the order-2 recursive filter 136 is obtained as a time-varying linear combination of the input sound sound signals 142 and 143 and unit-delayed versions 144 and 145 of the input sound signals 142 and 143. Departing from the time-varying input projection vectors $\underline{b}^1[n]$ and $\underline{b}^2[n]$ of an equivalent, mutable state-space filter in complex modal form (i.e., diagonal transition matrix), it should be straightforward for those skilled in the art to deduce: (a) the time-varying weights 146 and 147 respectively involved in linearly combining signals 142 and 143, and (b) the time-varying weights 148, 149, 150, and 151 respectively involved in linearly combining signals 144, 142, 145, and 143. Analogously, the input 139 of the order-1 recursive filter 135 will be obtained as a time-varying linear combination of the input sound sound signals 142 and 143, while the input 141 of the order-2 recursive filter 137 will be obtained as a time-varying linear combination of the input sound signals 142 and 143 and unit-delayed versions 144 and 145 of the input sound signals 142 and 143.

In view of these or other related embodiments employing a real parallel recursive filter representation, those practicing the invention should decide whether this representation is suitable for their needs. While real-coefficient recursive filters will sometimes be preferable because no complex multiplies are required, the complex modal form of a state-space representation presents some attractive features to be considered. For example, as described by Regalia et al. in "Implementation of Real Coefficient Digital Filters Using Complex Arithmetic", *IEEE Transactions on Circuits and Systems*, Vol. CAS-34:4, April 1987, the complex-conjugate symmetry properties of real systems expressed in complex form can lead to saving half of the operations involving complex-conjugate eigenvalues, thus approaching the total operation count required by an equivalent real form. Nevertheless, if choosing the real parallel recursive filter representation it would be preferred that input or output projection models are instead constructed to directly provide the real-valued weights used for time-varying linear combinations: for instance, in reference to the embodiment of FIG. 22, the real-valued weights 148, 149, 150, and 151 would be provided directly by an input projection model; that way, no additional operations would be required to compute them from the input projection vectors $\underline{b}^1[n]$ and $\underline{b}^2[n]$ as originally provided by a projection model constructed for an equivalent, mutable state-space filter in complex modal form.

Wave Propagation and Frequency-Dependent Attenuation

Figure 23A:
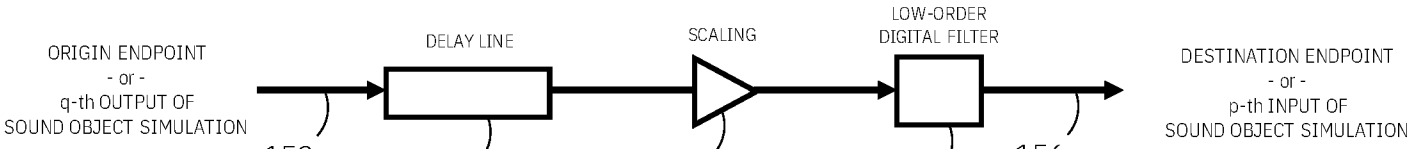
FIG. 23A is a block diagram illustrating the use of a delay line to propagate a sound signal from an origin endpoint to the input of a sound-receiving object simulation, or from the output of a sound-emitting object simulation to a destination endpoint, or from the output of a sound-emitting object simulation to the input of a sound-receiving object simulation; in all three cases, a scalar attenuation and a low-order digital filter are respectively used for simulating frequency-independent attenuation and frequency-dependent attenuation of propagating sound.
Figure 23B:
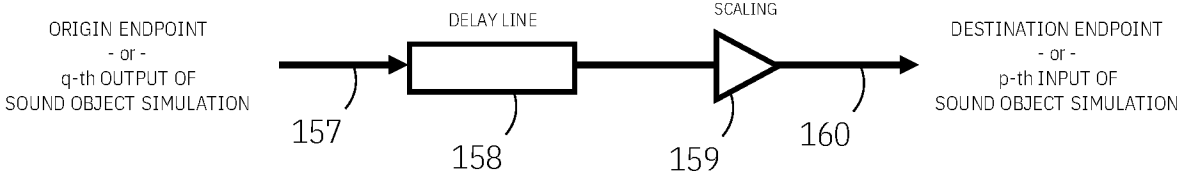
FIG. 23B is a block diagram illustrating the use of a delay line to propagate a sound signal, similar to that depicted in FIG. 23A, but only using scalar attenuation for simulating frequency-independent attenuation of propagating sound.
Figure 23C:
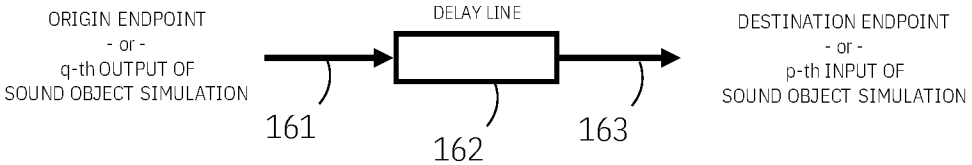
FIG. 23C is a block diagram illustrating the use of a delay line to propagate a sound signal, similar to that depicted in FIG. 23A, but not using a scalar attenuation or a low-order digital filter for simulating attenuation of propagating sound.

The simulation of sound wave propagation may be simplified in terms of individually modeled factors such as delay, distance-related frequency-independent attenuation, and frequency-dependent attenuation due to interaction with obstacles or other causes. Some embodiments of the invention will naturally incorporate these phenomena. First, sound wave propagation from and/or to source and/or receiver objects may rely on using delay lines, where the length (or number of taps) of said delay lines represents distance between emission and reception endpoints, and fractional delay lines can be used in cases where distances are time-varying. For distance-related frequency-independent attenuation, an attenuation coefficient can be easily applied to each propagated wavefront by accounting for the corresponding energy spreading. With respect to frequency-dependent attenuation due to obstacle interactions or other related causes (for example as a result of air absorption, or reflection and/or diffraction), it is customary to employ digital filters whose magnitude frequency response approximates a desired frequency-dependent attenuation profile expected for a particular wave propagation path. In view of this, the invention can be practiced in diverse contexts where the propagation of emitted and/or received wavefronts is simulated by means of delay lines and scalar attenuations and/or digital filters. To illustrate this, we depict three non-limiting examples in FIG. 23A, FIG. 23B, and FIG. 23C. In FIG. 23A, a simplified simulation for wave propagation is depicted where a wavefront or sound wave signal is propagated from an origin endpoint 152 or the output of a sound object simulation 152 to a destination endpoint 155 or the input of a sound object simulation 155, employing a delay line 153 for ideal propagation, a scaling 154 for frequency-independent attenuation, and a low-order digital filter 155 for frequency-dependent attenuation. In FIG. 23B, a further simplification is depicted where a wavefront or sound wave signal is propagated from an origin endpoint 157 or the output of a sound object simulation 157 to a destination endpoint 160 or the input of a sound object simulation 160, employing a delay line 158 for ideal propagation, a scaling 159 for frequency-independent attenuation, but omitting the explicit simulation of frequency-dependent attenuation. In FIG. 23C, an even further simplification is illustrated where a wavefront or sound wave signal is propagated from an origin endpoint 161 or the output of a sound object simulation 161 to a destination endpoint 163 or the input of a sound object simulation 160, employing a delay line 158 for ideal propagation, but omitting the explicit simulation of both frequency-independent attenuation and frequency-dependent attenuation.

Figure 24A:
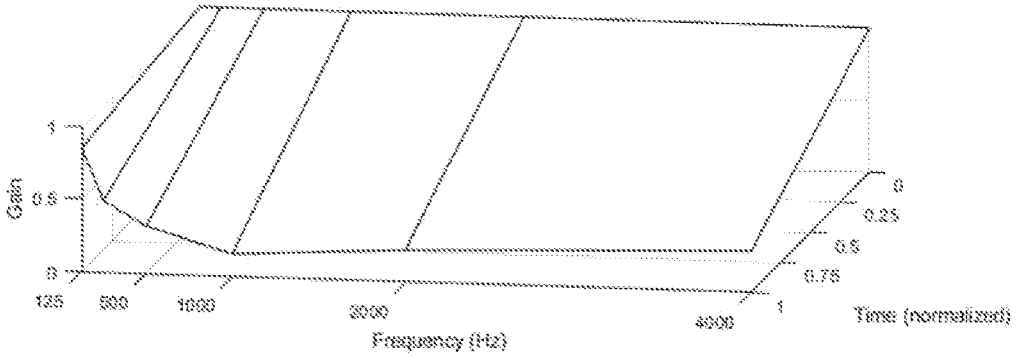
FIG. 24A depicts a target, time-varying magnitude frequency-dependent attenuation characteristic obtained by linearly interpolating between no attenuation and the attenuation caused by sound wavefront reflection off cotton carpet.
Figure 24B:
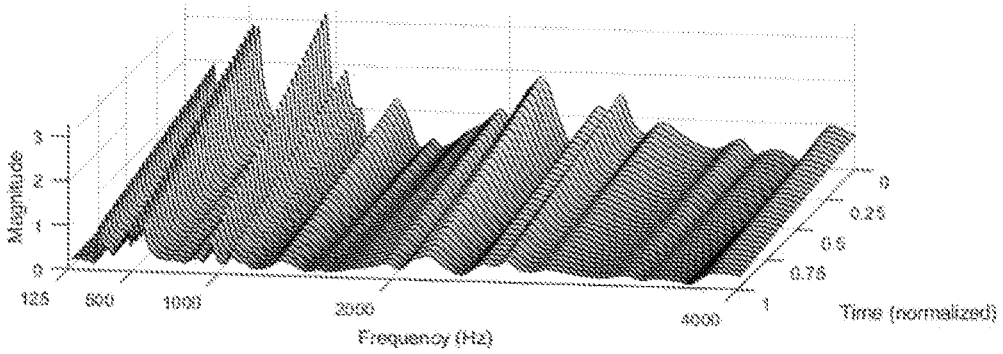
FIG. 24B depicts a time-varying magnitude frequency response to demonstrate the effect of time-varying frequency-dependent attenuation corresponding to the target characteristic of FIG. 24A when simulated by frequency-domain bin-by-bin filtering of a wavefront emitted towards a fixed direction by a violin object simulation similar to that demonstrated in FIG. 13B.
Figure 24C:
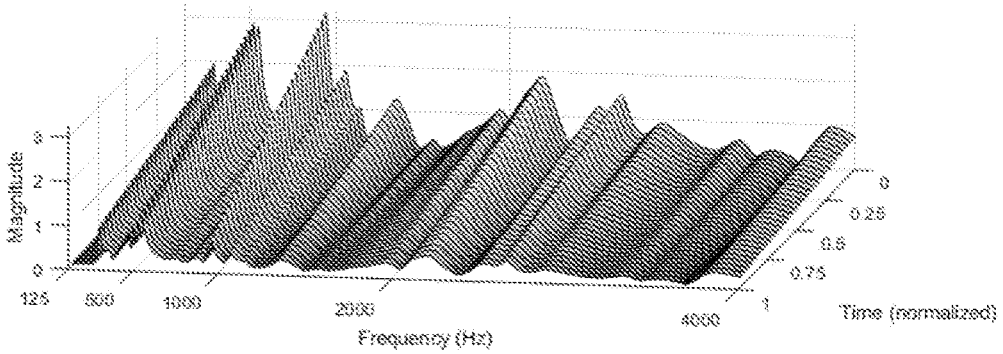
FIG. 24C, depicts a time-varying magnitude frequency response to demonstrate the effect of time-varying frequency-dependent attenuation corresponding to the target characteristic of FIG. 24A, this time simulated by real-valued attenuation of state variables at the time of output projection in a violin object simulation similar to that demonstrated in FIG. 13B, for the same fixed direction as that employed for FIG. 24*b*.
Figure 25:
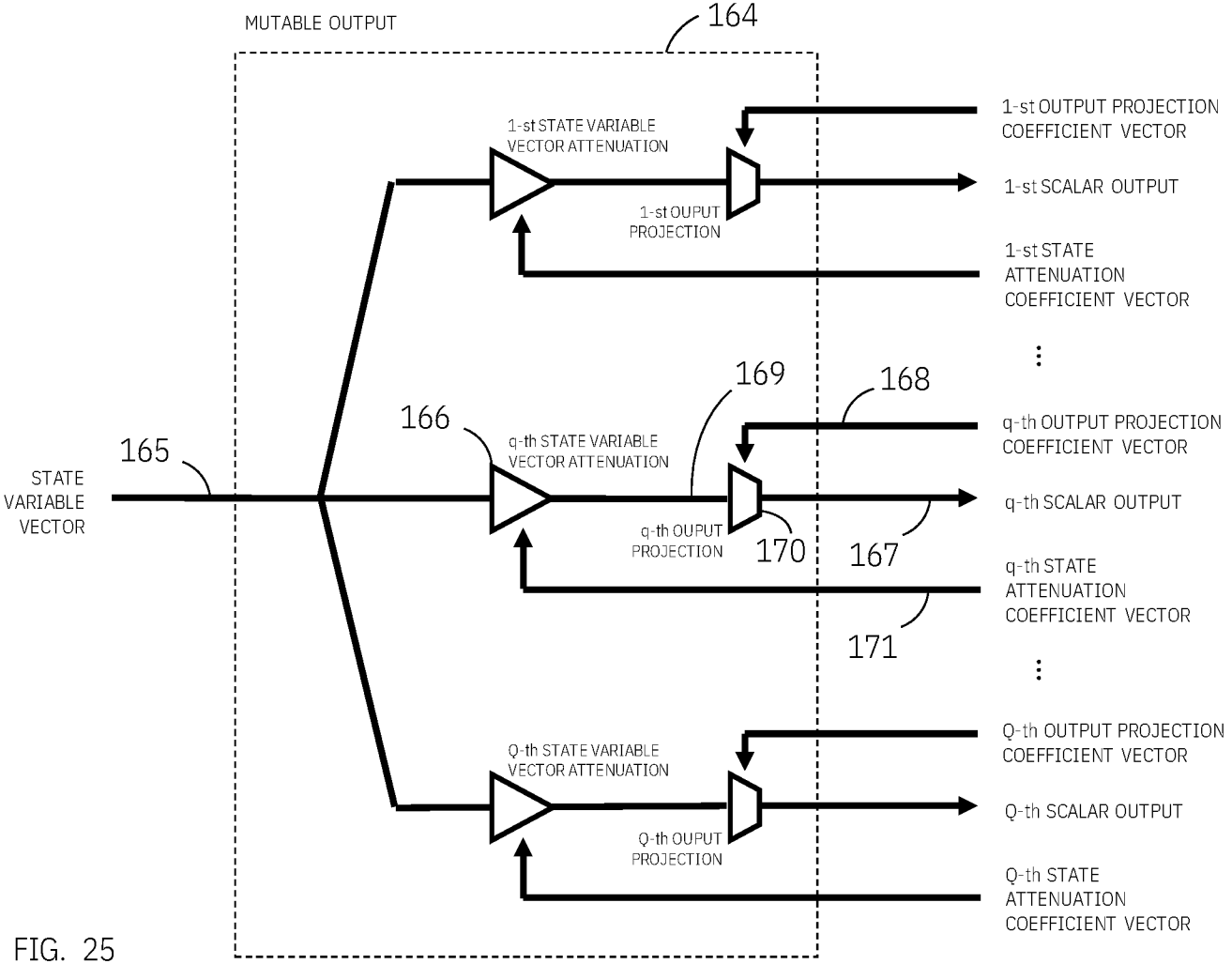
FIG. 25 is a block diagram of an example embodiment illustrating the use of state variable attenuation for the simulation of frequency-dependent attenuation of propagating sound at the time of output projection in a sound-emitting object simulation.

Though in some embodiments or practices it may be preferable to employ low-order digital filters to simulate the frequency-dependent attenuation corresponding to a given sound wave signal propagation (e.g., see FIG. 23A), the invention can be alternatively practiced so that the simulation of frequency-dependent attenuation can be performed as part of the simulation of sound emission or reception by sound objects. Assuming that the eigenvalues of an object model are conveniently distributed and their corresponding state variable signals carry representative low-pass (positive real eigenvalue), band-pass (complex-conjugate eigenvalue pair), or high-pass (negative real eigenvalue) components, it is possible to include an approximation of the frequency-dependent attenuation of sound wavefronts in terms of the input and/or output projection coefficient vectors employed during input or output projection, i.e. during reception or emission of sound wavefronts by objects. Without loss of generality, we employ here sound emission to describe a non-limiting embodiment that exemplifies the inclusion of frequency-dependent attenuation as part of the output projection operation by a sound source object simulation. Let us assume a source object simulation presenting M state variables. For a sound wavefront departing from the q-th output of the sound object, a desired frequency-dependent attenuation characteristic may be approximated in terms of a length-M vector $\underline{\alpha}^q[n]$ of attenuation coefficients each applied to one state variable at the time of output projection, i.e. $y^q[n]=\underline{c}^q[n]T\ (\underline{\alpha}^q[n]*\underline{s}[n])$ where '*' denotes element-wise vector multiplication. This way, the t q-th wavefront $y^q[n]$ already incorporates the desired attenuation characteristic. Note that for computing $y^q[n]$, attenuating state variables can be made equivalent to attenuating output projection coefficients, i.e., $y^q[n]=(\underline{\alpha}^q\ [n]*\underline{c}^q[n])^T\ \underline{s}[n]$. Note that the coefficient vector $\underline{\alpha}^q[n]$ could be obtained by attending to the eigenvalues of the sound object simulation, or simply through table lookups or other suitable techniques. For the case of the violin simulation described before, real-valued attenuation coefficients can be obtained for each state variable by sampling a desired frequency-dependent attenuation characteristic at each of the characteristic frequencies respectively associated with each eigenvalue. We illustrate this in FIG. 24A, FIG. 24B, and FIG. 24C, where time-varying frequency-dependent attenuation is demonstrated: in FIG. 24A it is displayed a desired, time-varying frequency-dependent attenuation characteristic obtained by linearly interpolating between no attenuation and the attenuation caused by wavefront reflection off cotton carpet; in FIG. 24B it is displayed the corresponding effect of time-varying frequency-dependent attenuation as simulated by frequency-domain, magnitude-only, bin-by-bin attenuation of a wavefront emitted towards a fixed direction by a violin object simulation (similar to that demonstrated in FIG. 13B); in FIG. 24C, for comparison, it is displayed the corresponding effect of time-varying frequency-dependent attenuation simulated by real-valued attenuation of state variables at the time of output projection as employed in the same violin object simulation for wavefront emission towards a fixed direction. In relation to this example practice of frequency-dependent attenuation, a non-limiting embodiment of a sound-emitting object simulation employing a mutable state-space formulation is depicted in FIG. 25 where a representation of the mutable output 164 of said object simulation includes only three mutable outputs for illustrative purposes: in particular for obtaining the q-th mutable output 167, the vector 165 of state variables of the object simulation is first attenuated 166 via element-wise multiplication by a vector 171 of state attenuation coefficients to obtain a vector 169 of attenuated state variables which, then, are linearly combined 170 using respective output projection coefficients 168 to obtain the scalar output 167. It is worth noting that, given that the simulation of sound emission and frequency-dependent attenuation can be equivalently expressed by $y^q[n]=(\underline{\alpha}^q[n]*\underline{c}^q[n])^T\ \underline{s}[n]$ as detailed before, the invention could be alternatively be practiced in such a way that, for efficiency, a sole set of output projection coefficients $\underline{c}^q[n]$ are used to jointly represent emission and frequency-dependent attenuation simultaneously: in such case, the output coordinates used to obtain the output projection coefficients corresponding to a given q-th output can include information about said attenuation; actually, even other relevant factors such as diffraction, obstruction, or near-field effects can be incorporated as long as they can be effectively simulated via linear combination of the state variables of a sound-emitting object simulation. As well, given the functional similarity of input projection and output projection operations in sound-emitting and sound-receiving object simulations, it will be straightforward for those skilled in the art to practice analogous embodiments of the inventive system for the case of sound-receiving object simulations if desired: for instance, jointly simulating sound reception and other effects like frequency-dependent attenuation of sound wavefronts due to propagation, reflection, obstruction, or even near-field effects.

State Wave Form

Figure 26A:
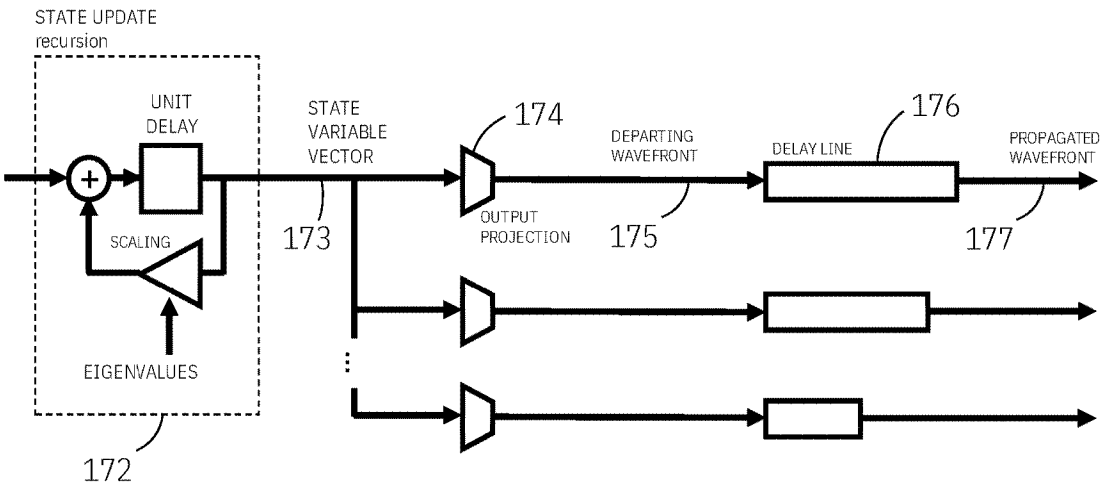
FIG. 26A is a block diagram of an example generic embodiment illustrating the simulation of sound emission by a sound object simulation and sound propagation of emitted sound wavefronts in which each scalar delay line is used to propagate an individual sound wavefront.

In alternative embodiments of the inventive system the phenomena of sound emission by sound-emitting objects, sound wavefront propagation, and sound reception by sound-receiving objects can be simulated by treating the state variables of source object simulations as propagating waves as follows. We refer here to these embodiments as "state wave form embodiments". By attending to Equation (1), it should be noted that a sound wavefront $y^q$ [n] departing from a sound-emitting object is obtained from the state variables $\underline{s}[n]$ of the object simulation and the vector $\underline{c}^q[n]$ of coefficients involved in the output projection. Once the output projection is performed, wave propagation can be simulated by feeding $y^q$ [n] into a delay line, as illustrated in FIG. 23C for a minimal embodiment including emission, delay-based propagation, and reception only. Let us assume that a sound-emitting object model is feeding a sound wavefront signal $y^q$ [n] into a fractional delay line, and let us express the output signal $d^q$ [n] of such delay line as $d^q[n]=y^q[n-l[n]]$, with l[n] being the amount of delay expressed in samples. By virtue of Equation (1), it is possible to alternatively express $d^q$ [n] in terms of the state variable vector [n] and the output projection coefficient vector $\underline{c}^q[n]$ via $d^q[n]=(\underline{c}^q[n-l[n]])^T\underline{s}[n-l[n]]$, where $\underline{c}^q[n-l[n]]$ and $\underline{s}[n-l[n]]$ are delayed versions of the corresponding output projection vector and the state variable vector respectively. Since the delayed coefficient vector $\underline{c}^q[n-l[n]]$ can be equally obtained (see Equation 3) from delayed output coordinates, propagation of sound signals emitted by source object simulations can thus be practiced by delaying state variables of source object simulations and, if necessary, the corresponding output coordinates. To illustrate this, we depict in FIG. 26A and FIG. 27B two partial, non-limiting embodiments of the invention when practiced by means of delay-line propagation of emitted sound wavefronts (FIG. 26A) and delay-line propagation of state variables (FIG. 26B) respectively. Both figures depict sound wavefront emission by an sound-emitting object simulation embodied by an object simulation employing a mutable state-space filter representation (see FIG. 4, FIG. 5, and FIG. 6 for reference) with three mutable outputs. Details are provided only for one output, but it would be applicable for any number of outputs. In FIG. 26A, the state variable vector 173 provided by the state variable recursive update 172 is first used for output projection 174 to obtain the sound wavefront 175 emitted by the sound object simulation, and said sound wavefront is fed into a scalar delay line 176 for propagation, leading to an emitted and propagated sound wavefront 177. Conversely, in FIG. 26B depicting a state wave form embodiment, the state variable vector 179 provided by the state variable recursive update 178 is first fed into a vector delay line 180 for state variable vector propagation, and tapping from said vector delay line leads to a vector of delayed state variables 181 which, through output projection 182, provides an emitted and propagated sound wavefront 183.

Figure 26B:
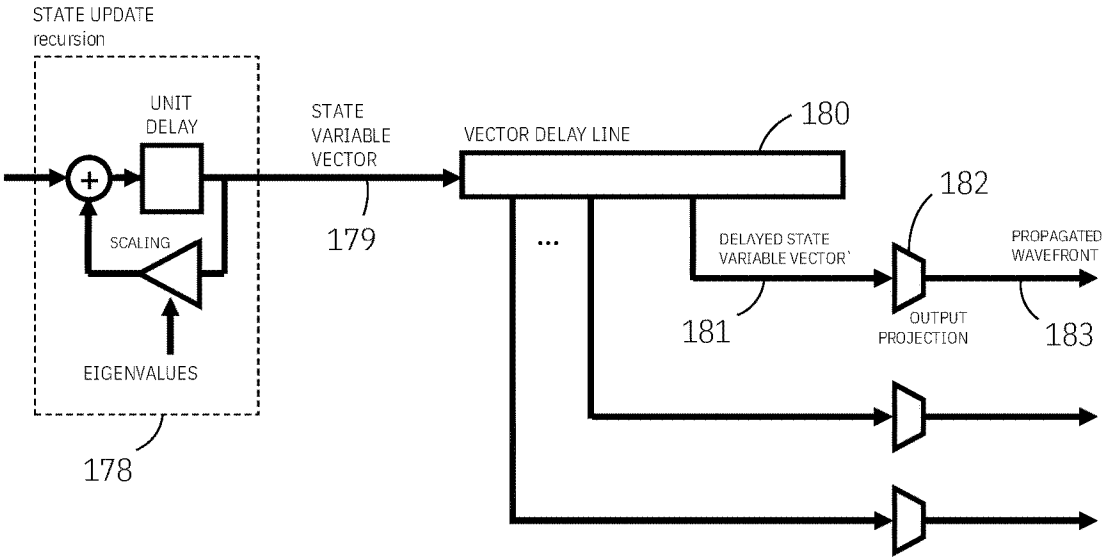
FIG. 26B is a block diagram of an example generic embodiment illustrating the simulation of sound emission by a sound object simulation and sound propagation of emitted sound wavefronts, functionally equivalent to that of FIG. 26A, but using a sole vector delay line to propagate the state variables of a sound-emitting object simulation.

It will be clear to those skilled in the art that state wave form embodiments, i.e. those similar to the one described here and exemplified by FIG. 26B, can incur an increase in the cost induced by fractional delay interpolation but be advantageous in diverse application and implementation contexts because, while allowing the simulation of frequency-dependent sound emission characteristics of sound-emitting objects, the need for delay lines dedicated to individual wavefront propagation paths disappears: irrespective of the number of dynamically changing sound wavefront paths included in a simulation, the number of delay lines can be solely determined by the number of sound-emitting object simulations and their state variables.

Figure 27:
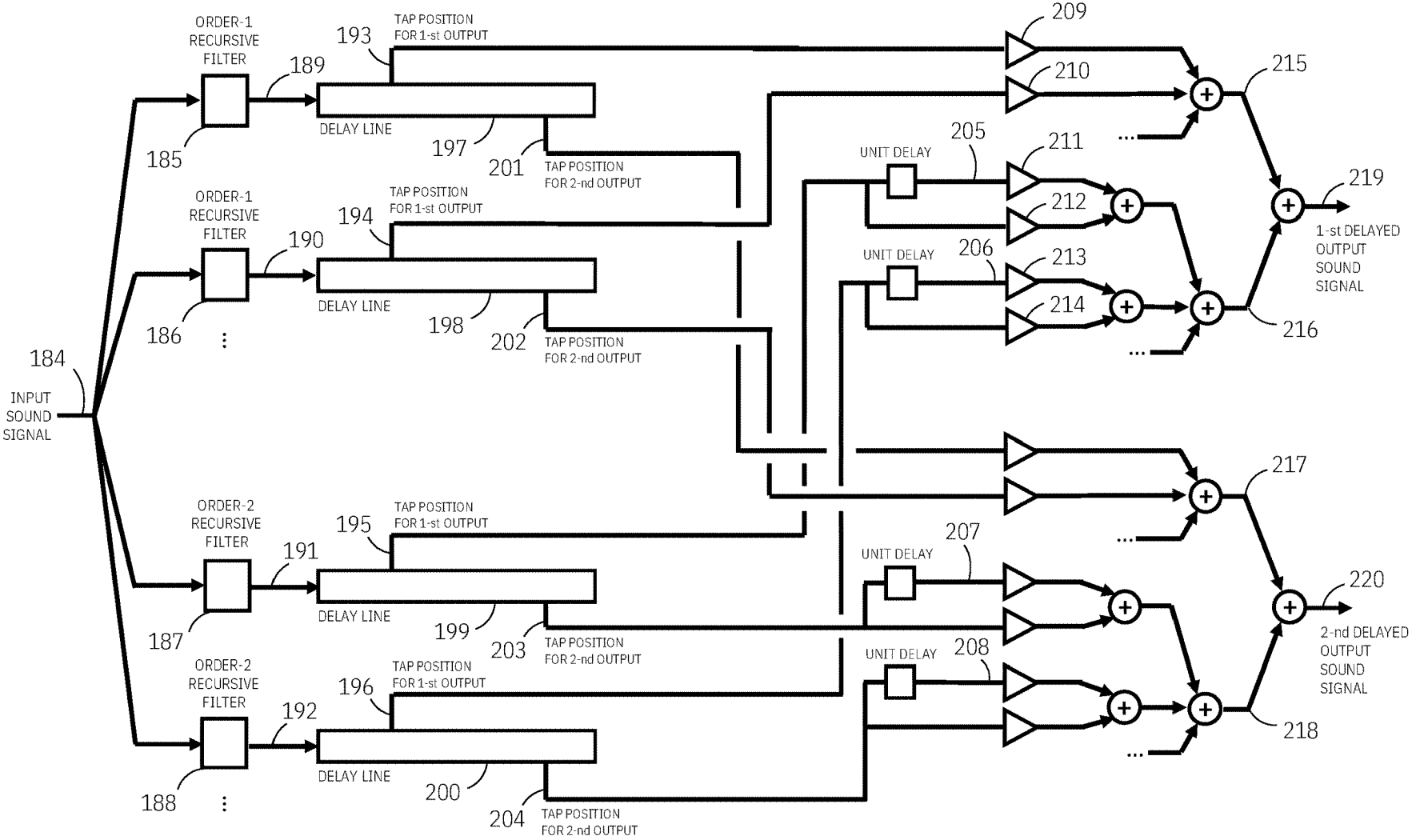
FIG. 27 is a block diagram of an example generic embodiment illustrating the simulation of sound emission by a sound object simulation and sound propagation of emitted sound wavefronts, functionally equivalent to that of FIG. 26B, but using a real parallel recursive filter representation.

For completeness, in FIG. 27 we depict a non-limiting state wave form embodiment where a sound-emitting object simulation is realized by a real parallel recursive filter of similar function to that depicted in FIG. 21 but also including propagation. For brevity, only two order-1 recursive filters, two order-2 recursive filters, and two outputs are displayed. First, the input sound signal 184 of a sound-emitting object simulation is fed into both order-1 recursive filters 185 and 186, as well as into both order-2 recursive filters 187 and 188. The outputs 189, 190, 191, and 192 of said recursive filters are respectively fed into delay lines 197, 198, 199, and 200. To obtain the first emitted and propagated sound signal 219, the four delay lines are tapped at a common position according to the distance traveled by the sound signal 219, leading to delayed filtered variables 193, 194, 195, and 196. The output sound signal 219 is then obtained by adding a time-varying linear combination 215 of first-order delayed filtered signals 193 and 194 and a time-varying linear combination 216 of second-order delayed filtered signals 195 and 196 and unit-delayed versions 205 and 206 of the second-order delayed filtered signals 195 and 196. The time-varying weights 209, 210, 211, 212, 213, and 214 involved in obtaining the output sound signal 219 are adapted, as described for the embodiment depicted in FIG. 21, to the output coordinates dictating the output projection corresponding to said output sound signal. To obtain the second emitted and propagated sound signal 220, the four delay lines are tapped at a common position according to the distance traveled by the sound signal 220, leading to delayed filtered variables 201, 202, 203, and 204. Accordingly, the output sound signal 220 is then obtained by adding a time-varying linear combination 217 of first-order delayed filtered signals 201 and 202 and a time-varying linear combination 218 of second-order delayed filtered signals

203 and 204 and unit-delayed versions 207 and 208 of the second-order delayed filtered signals 203 and 204.

Note that although for clarity we only included sound emission and propagation simulation in the exemplary state wave form embodiments described here, sound reception, frequency-dependent attenuation, and other effects can still be accommodated as taught by the invention. For instance, frequency-dependent attenuation can be simulated either by using a dedicated digital filter applied after output projection (e.g., applied to signal 183 in FIG. 26B or to signal 219 in FIG. 27), or even during output projection in terms of output projection coefficients (e.g., as incorporated by the coefficients used in the output projection 182 of FIG. 26B or by the coefficients 209, 210, 211, 212, 213, or 214 used for output projection in FIG. 27).

Straightforward Variations

Thanks to the flexibility and versatility of the inventive system, straightforward variations are still possible within the spirit of the invention. For reasons of generality, a state-space representation was chosen to describe the basics of the invention; in the state-space representations, a feed-forward term as omitted for brevity, but it should be straightforward for those skilled in the art to include a feed-forward term in state-space filter embodiments or, accordingly, in real parallel filter embodiments. Object simulation models with matching input and output coordinate spaces can be constructed to simulate sound scattering by objects. If, for instance, it is desired to simulate both sound scattering and emission by a sound object or sound scattering and reception by a sound object, any required output or input coordinate spaces can be employed for said sound object simulations while following the teachings of the invention, either by using common coordinate spaces but separate state variable sets, or by using both common coordinate spaces and state variable sets. Potentially convenient variations will jointly simulate emission, reception, frequency-dependent attenuation or other desired effects at the time of either input projection and output projection: for instance, sound emission characteristics of a source object and frequency-dependent attenuation due to propagation or other effects can be simulated in terms of the state variables and eigenvalues used for modeling sound reception by a different sound object; this means that a sole recursive filter structure can be used for a receiver object simulation whose input coordinates incorporate information not only about sound reception by said sound object, but also about sound emission by a sound-emitting object, frequency-dependent attenuation of propagated sound, or other effects induced by for instance the position or orientation of a sound-emitting object in relation to the position or orientation of the said receiver object, thus achieving significant computational savings as a sole input projection operation is required for simulating several effects.

The invention claimed is:

1. A system for numerical simulation of sound reception employing at least one mutable state-space filter, characterized in that:

the input vector of said mutable state-space filter comprises a time-varying number of components and said mutable state-space filter comprises an input matrix of time-varying size and time-varying coefficients, wherein the time-varying size of said input matrix is characterized in that said input matrix comprises a time-varying number of input projection vectors; and said system comprises at least one processor and memory comprising executable instructions which, when executed by the at least one processor, cause the system to:

receive a time-varying number of input sound signals corresponding to a plurality of received sound wavefronts in a virtual environment, wherein at least one of said input sound signals is fed into one component of said input vector;

receive a time-varying number of input coordinate signals, wherein at least one of said input coordinate signals is associated to at least one of said received sound wavefronts; and translate at least one of said input coordinate signals into at least one of the coefficients comprised in at least one of said input projection vectors, wherein said translating comprises evaluating a parametric model or performing a table lookup, wherein the number of input projection vectors comprised in said input matrix is determined based at least in part on the number of said received sound wavefronts, and wherein at least one of said input projection vectors is associated to one of said received sound wavefronts.

2. A system for numerical simulation of sound emission employing at least one mutable state-space filter, characterized in that:

the output vector of said mutable state-space filter comprises a time-varying number of components and said mutable state-space filter comprises an output matrix of time-varying size and time-varying coefficients, wherein the time-varying size of said output matrix is characterized in that said output matrix comprises a time-varying number of output projection vectors; and said system comprises at least one processor and memory comprising executable instructions which, when executed by the at least one processor, cause the system to:

provide a time-varying number of output sound signals corresponding to a plurality of emitted sound wavefronts in a virtual environment wherein at least one of said output sound signals is fed from one component of said output vector;

receive a time-varying number of output coordinate signals wherein at least one of said output coordinate signals is associated to at least one of said emitted sound wavefronts; and translate at least one of said output coordinate signals into at least one of the coefficients comprised in at least one of said output projection vectors, wherein said translating comprises evaluating a parametric model or performing a table lookup, wherein the number of output projection vectors comprised in said output matrix is determined based at least in part on the number of said emitted sound wavefronts, and wherein at least one of said output projection vectors is associated to one of said emitted sound wavefronts.

3. The system of claim 1, configured to equivalently operate as a parallel array of first- and/or second-order recursive filters wherein said recursive filters are fed with linear combinations of said input sound signals and/or unit-delayed copies of said input sound signals, wherein said linear combinations use time-varying coefficients translated from said input coordinate signals.

4. The system of claim 2, configured to equivalently operate as a parallel array of first- and/or second-order recursive filters wherein said output sound signals are obtained by linear combinations of the outputs of said recursive filters and/or unit-delayed versions of the outputs of said recursive filters, wherein said linear combinations use time-varying coefficients translated from said output coordinate signals.

5. A system according to claim 1, characterized in that the effect of frequency-dependent attenuation suffered by a at least one of said received sound wavefronts as a result of propagation is attained by scaling at least one of the coefficients comprised in an input projection vector associated to the at least one of said received sound wavefronts.

6. A system according to claim 2, characterized in that the effect of frequency-dependent attenuation suffered by at least one of said emitted sound wavefronts as a result of propagation is attained by scaling at least one of the coefficients comprised in a an output projection vector respectively associated to the at least one of said emitted sound wavefronts.

7. A system according to claim 3, characterized in that the effect of frequency-dependent attenuation suffered by at least one of said received sound wavefronts as a result of propagation is attained by scaling at least one of the coefficients employed for linearly combining the input sound signal corresponding to said received sound wavefront.

8. A system according to claim 4, characterized in that the effect of frequency-dependent attenuation suffered by at least one of said emitted sound wavefronts as a result of propagation is attained by scaling at least one of the coefficients employed in a linear combination used to obtain the output sound signal corresponding to said emitted sound wavefront.

9. A system according to claim 1 or 3, characterized in that the effect of frequency-dependent attenuation suffered by at least one of said received sound wavefronts as a result of propagation is included in the simulation of sound reception, wherein at least one of said input coordinates convey information about at least one attribute of position, orientation, propagation distance, propagation-induced attenuation, or obstacle-induced attenuation.

10. A system according to claim 2 or 4, characterized in that the effect of frequency-dependent attenuation suffered by at least one of said emitted sound wavefronts as a result of propagation is included in the simulation of sound emission, wherein at least one of said output coordinates convey information about at least one attribute of position, orientation, propagation distance, propagation-induced attenuation, or obstacle-induced attenuation.

11. A system according to claim 2, wherein:

the system further comprises as many variable-length delay lines as state variables are comprised in the state variable vector of said mutable state-space filter, wherein said state variables are fed into said delay lines;

the emission and propagation of at least one sound wavefront propagated in the virtual environment are jointly simulated by tapping from said delay lines at a desired length to obtain delayed state variables, and linearly combining said delayed state variables to obtain an output sound signal corresponding to said propagated sound wavefront, wherein the coefficients used for linearly combining said delayed state variables are translated from one or more output coordinate signals associated to said propagated sound wavefront, wherein said translation involves evaluating a parametric model or performing a table lookup.

12. A system according to claim 11, characterized in that the effect of frequency-dependent attenuation suffered by said propagated sound wavefront as a result of propagation is attained by scaling at least one of the coefficients employed for linearly combining said delayed state variables.

13. A system according to claim 11, characterized in that the effect of frequency-dependent attenuation suffered by said propagated sound wavefront as a result of propagation is included in the simulation of sound emission, wherein at least one of said output coordinates convey information about at least one attribute of position, orientation, propagation distance, propagation-induced attenuation, or obstacle-induced attenuation.

14. A system according to claim 4, wherein:

the system further comprises as many variable-length delay lines as first- and/or second-order recursive filters are comprised in the system, wherein the outputs of said recursive filters are fed into said delay lines; and the emission and propagation of at least one sound wavefront propagated in the virtual environment are jointly simulated by tapping from said delay lines at a desired length to obtain delayed recursive filter outputs, and linearly combining said delayed recursive filter outputs to obtain an output sound signal corresponding to said propagated sound wavefront, wherein the coefficients used for linearly combining said delayed recursive filter outputs are translated from one or more output coordinate signals associated to said propagated sound wavefront, wherein said translation involves evaluating a parametric model or performing a table lookup.

15. A system according to claim 14, characterized in that the effect of frequency-dependent attenuation suffered by said propagated sound wavefront as a result of propagation is attained by scaling at least one of the time-varying coefficients employed for linearly combining said delayed recursive filter outputs.

16. A system according to claim 14, characterized in that the effect of frequency-dependent attenuation suffered by said propagated sound wavefront as a result of propagation is included in the simulation of sound emission, wherein at least one of said output coordinates convey information about at least one attribute of position, orientation, propagation distance, propagation-induced attenuation, or obstacle-induced attenuation.

17. A method for numerical simulation of sound reception employing a mutable state-space filter wherein the input vector of said mutable state-space filter presents a time-varying number of components, and wherein said mutable state-space filter comprises an input matrix of time-varying size and time-varying coefficients, comprising the steps of:

receiving a time-varying number of input sound signals corresponding to a plurality of received sound wavefronts in a virtual environment, wherein at least one of said input sound signals is fed into one component of said input vector;

receiving one or more input coordinate signals associated to at least one of said received sound wavefronts;

adapting the size of said input matrix so that it comprises one or more input projection vectors, wherein the number of said input projection vectors is determined at least in part by the number of said received sound wavefronts;

translating, by evaluating a parametric model or performing a table lookup, at least one of said input coordinate signals into at least one of the coefficients comprised in at least one of the input projection vectors comprised in said input matrix; and collecting at least one output of said mutable state-space filter to provide at least one output sound signal.

18. A method according to claim 17, characterized in that said mutable state-space filter is configured to equivalently operate as an array of first- and/or second-order recursive filters, comprising the steps of:

receiving a time-varying number of input sound signals corresponding to a plurality of received sound wavefronts in a virtual environment;

receiving a time-varying number of input coordinate signals associated to at least one of said received sound wavefronts;

feeding said recursive filters with linear combinations of said input sound signals and/or unit-delayed copies of said input sound signals, wherein said linear combinations employ coefficients translated from said input coordinate signals by evaluating a parametric model or performing a table lookup; and providing at least one output sound signal by linearly combining at least one of the outputs of said recursive filters.

19. A method for numerical simulation of sound emission employing a mutable state-space filter wherein the output vector of said mutable state-space filter present a time-varying number of components, and wherein said mutable state-space filter comprises an output matrix of time-varying size and time-varying coefficients, comprising the steps of:

receiving at least one input sound signal and feeding said input sound signal to at least one input of said mutable state-space filter;

receiving a time-varying number of output coordinate signals associated to at least one of a plurality of emitted sound wavefronts in a virtual environment;

adapting the size of said output matrix so that it comprises one or more output projection vectors, wherein the number of said output projection vectors is determined at least in part by the number of said emitted sound wavefronts;

translating, by evaluating a parametric model or performing a table lookup, at least one of said output coordinate signals into at least one of the time-varying coefficients comprised in at least one of the output projection vectors comprised in said output matrix; and providing a time-varying number of output sound signals corresponding to said emitted sound wavefronts, wherein at least one of said output sound signals is fed from one component of said output vector.

20. A method according to claim 19, characterized in that said mutable state-space filter is configured to equivalently operate as an array of first- and/or second-order recursive filters, comprising the steps of:

receiving at least one input sound signal and use said input sound signal to feed the input of at least one of said recursive filters;

receiving a time-varying number of output coordinate signals associated to at least one of a plurality of emitted sound wavefronts in a virtual environment;

providing a time-varying number of output sound signals, wherein said output sound signals correspond to said plurality of emitted sound wavefronts, wherein at least one of said output sound signals is obtained by linearly combining the outputs of said recursive filters and/or unit-delayed copies of the outputs of said recursive filters, wherein said linear combinations employ coefficients translated from said output coordinate signals by evaluating a parametric model or performing a table lookup.

21. A method according to claim 17 or 18, characterized in that the effect of frequency-dependent attenuation suffered by at least one of said received sound wavefronts as a result of propagation is included in the simulation of sound reception, wherein at least one of said input coordinates convey information about at least one attribute of position, orientation, propagation distance, propagation-induced attenuation, or obstacle-induced attenuation.

22. A method according to claim 19 or 20, characterized in that the effect of frequency-dependent attenuation suffered by at least one of said emitted sound wavefronts as a result of propagation is included in the simulation of sound emission, wherein at least one of said output coordinates convey information about at least one attribute of position, orientation, propagation distance, propagation-induced attenuation, or obstacle-induced attenuation.

23. A method according to claim 19, characterized in that:

the method further comprises a step of feeding the state variables of said mutable state-space filter into delay lines of variable length;

the emission and propagation of at least one sound wavefront propagated in the virtual environment are jointly simulated by a step of tapping from said delay lines at a desired length to obtain delayed state variables, and a step of linearly combining said delayed state variables to obtain an output sound signal corresponding to said propagated sound wavefront, wherein the coefficients used for linearly combining said delayed state variables are translated from one or more output coordinate signals associated to said propagated sound wavefront, wherein said translation involves evaluating a parametric model or performing a table lookup.

24. A method according to claim 20, characterized in that:

the method further comprises a step of feeding the outputs of said first- and/or second-orders recursive filters into delay lines of variable length; and the emission and propagation of at least one sound wavefront propagated in the virtual environment are jointly simulated by a step of tapping from said delay lines at a desired length to obtain delayed recursive filter outputs, and a step of linearly combining said delayed recursive filter outputs to obtain an output sound signal corresponding to said propagated sound wavefront, wherein the coefficients used for linearly combining said delayed recursive filter outputs are translated from one or more output coordinate signals associated to said propagated sound wavefront, wherein said translation involves evaluating a parametric model or performing a table lookup.

25. A method according to claim 23 or 24, characterized in that the effect of frequency-dependent attenuation suffered by at least one of said emitted sound wavefronts as a result of propagation is included in the simulation of sound emission, wherein at least one of said output coordinates convey information about at least one attribute of position, orientation, propagation distance, propagation-induced attenuation, or obstacle-induced attenuation.

* * * * *